US010690428B1

(12) United States Patent
Vestbom et al.

(10) Patent No.: US 10,690,428 B1
(45) Date of Patent: Jun. 23, 2020

(54) FIREARM RECEIVER TIGHTENING SYSTEM

(71) Applicant: MOA Dynamics LLC, Cornwall, NY (US)

(72) Inventors: Ralph B. Vestbom, Cliffside Park, NJ (US); Kristopher L. Porter, New Windsor, NY (US)

(73) Assignee: MOA Dynamics LLC, Cornwall, NY (US)

( * ) Notice: Subject to any disclaimer, the term of this patent is extended or adjusted under 35 U.S.C. 154(b) by 0 days.

(21) Appl. No.: 16/695,609

(22) Filed: Nov. 26, 2019

Related U.S. Application Data

(60) Provisional application No. 62/877,851, filed on Jul. 24, 2019.

(51) Int. Cl.

| | |
|---|---|
| ***F41A 11/00*** | (2006.01) |
| ***F41A 11/02*** | (2006.01) |
| ***F41A 17/04*** | (2006.01) |
| ***F41A 27/30*** | (2006.01) |

(52) U.S. Cl.
CPC ..... *F41A 11/02* (2013.01); *F41A 17/04* (2013.01); *F41A 27/30* (2013.01)

(58) Field of Classification Search
CPC ..... F41A 11/00; F41A 3/66
See application file for complete search history.

(56) References Cited

U.S. PATENT DOCUMENTS

| | | | | |
|---|---|---|---|---|
| 9,909,828 | B1 * | 3/2018 | Klein | F41A 11/00 |
| 2012/0063841 | A1 * | 3/2012 | Fluhr | F41A 11/00 403/294 |
| 2012/0167433 | A1 * | 7/2012 | Robbins | F41A 3/66 42/75.02 |
| 2017/0227312 | A1 * | 8/2017 | Christensen | F41A 9/66 |

* cited by examiner

*Primary Examiner* — J. Woodrow Eldred
(74) *Attorney, Agent, or Firm* — John Maldjian; Maldjian Law Group LLC

(57) ABSTRACT

A method of assembling a lower receiver and an upper receiver of a firearm is disclosed. The method comprising steps of providing a threaded fastener; inserting the threaded fastener into a ratchet handle; mounting a ratchet gear into the ratchet handle, wherein the threaded fastener passes through an aperture of the ratchet handle and threads into the ratchet gear; positioning a locking plate at the lower receiver, wherein the locking plate is fixed to the ratchet handle by turning and tightening the ratchet handle with the engaged ratchet gear for locking to the locking plate in a locked position; and on the opposite side of the lower receiver, inserting a threaded pivot pin into an aperture of the locking plate from the opposite side of the lower receiver, wherein a threaded rod of the ratchet gear is threaded into a threading cavity of the pivot pin.

23 Claims, 22 Drawing Sheets

600

800

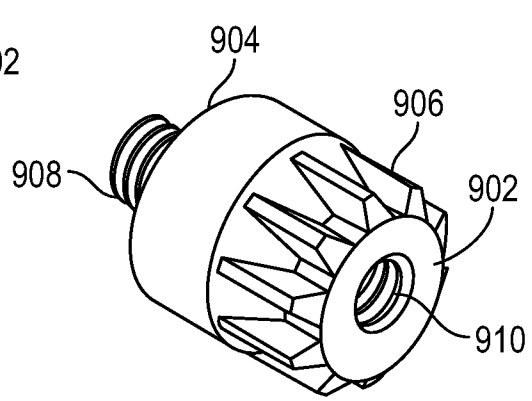
FIG. 9A
FIG. 9B
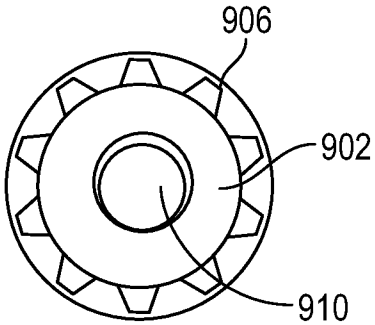
FIG. 9C
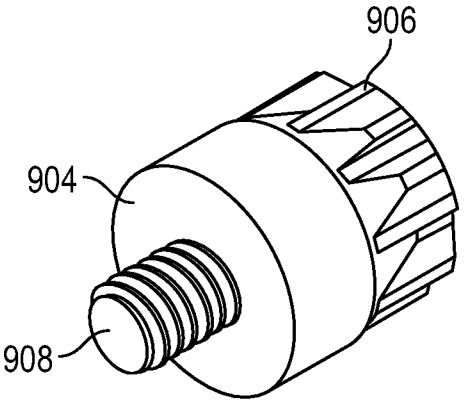
FIG. 9D
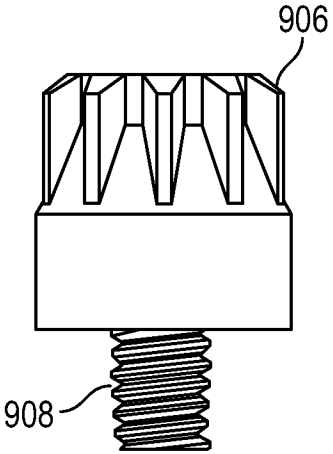
FIG. 9E
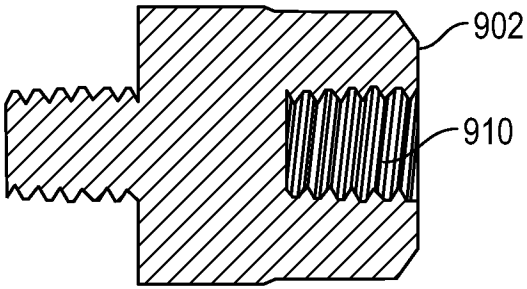
FIG. 9F
900

1200

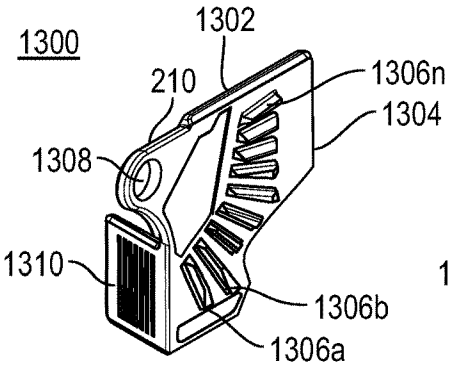
FIG. 13A
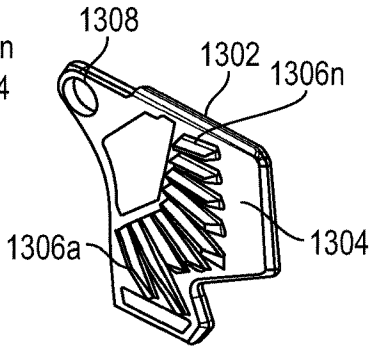
FIG. 13B
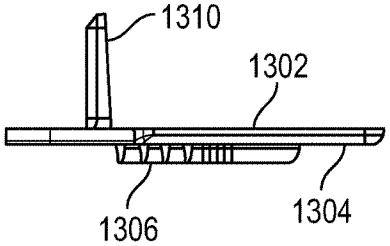
FIG. 13C
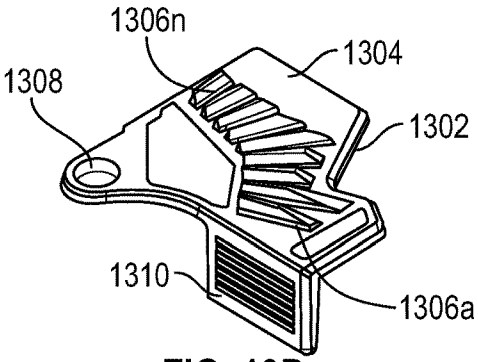
FIG. 13D
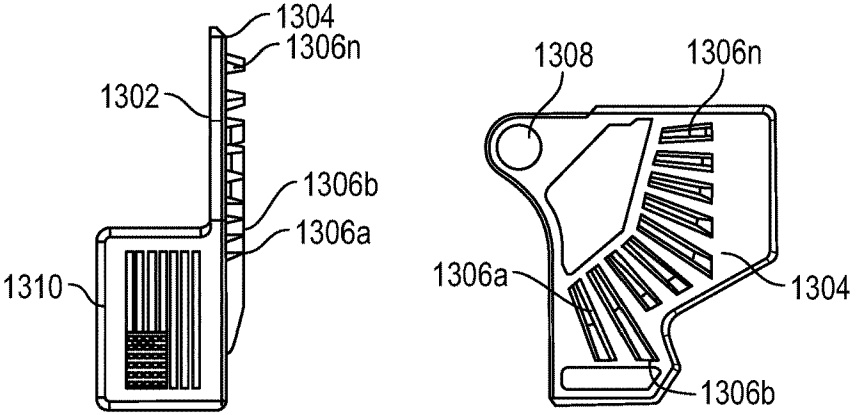
FIG. 13E
FIG. 13F
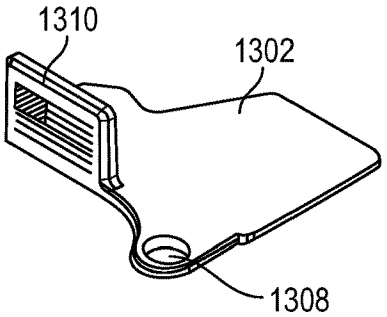
FIG. 13G
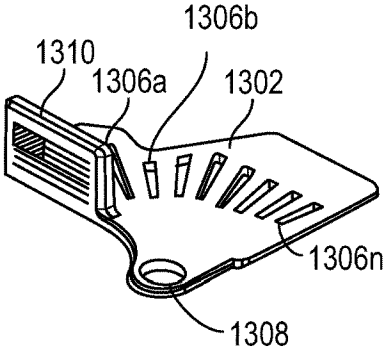
FIG. 13H

1400

FIREARM RECEIVER TIGHTENING SYSTEM

CROSS REFERENCE TO RELATED APPLICATIONS

This application claims the benefits of U.S. Provisional Application Ser. No. 62/877,851, filed Jul. 24, 2019, entitled "FIREARM RATCHET HANDLE ASSEMBLY" which is incorporated herein for reference in its entirety.

BACKGROUND

Field of Invention

Embodiments disclosed herein relate, in general, to firearms and, more particularly, to the stabilization of firearms.

Description of Related Art

A firearm is a weapon that fires rounds of ammunition and is used for hunting and to defend against intruders, criminals, terror attacks, and so forth. The firearm may be of different variety such as, but not limited to, a handgun, a pistol, a long gun, a rifle, an automatic rifle, a semi-automatic rifle, a shotgun, a machine gun, an automatic weapon, a semi-automatic weapon, etc.

Certain firearms such as the AR10, AR15, and other similar type of firearms and designs have long been used in a variety of applications including, but not limited to, by military, police, civilian hunters, and sport shooters. These types of firearms comprise a lower receiver portion having a stock coupled to a rear end connected to an upper receiver having a barrel coupled to a front end. When joining the upper and lower receiver portions to assemble the firearm, an excess movement or a "play" is introduced to the assembly. This excess movement or the "play" may further cause "wiggle", "waggle,", "bob", and "slop" that introduce a degree of inaccuracy due to instability of the assembly, which is not easily addressed in situ.

Conventional systems have identified the problem of instability and inaccuracy but not adequately solved the problem, which decreases efficacy of the firearm through the introduction of rotation, torque, vibration, or unexpected displacement. Current conventional systems pin the upper and lower receivers of a firearm at two locations. There is a "Takedown Pin" in the rear and a "Pivot Pin" in the front. Each of these pins is essentially a straight bolt having a machined straight slot and bores to accept a detent to keep the pins from falling out during firing and or during assembly, disassembly, or maintenance. To overcome the problem of inaccuracy and instability, some other proposed solutions use parts such as, but not limited to, shims, O-rings, wedges, and so forth, to mitigate the instability and inaccuracy issue. However, these approaches do not provide a convenient and better solution.

Thus, there is a need for a device, a system and a method for fixing the upper and lower receivers of a firearm and provide stabilization of the firearm during firing and therefore, improving accuracy.

SUMMARY

Embodiments in accordance with the present invention provide a method of assembling a lower receiver and an upper receiver of a firearm. The method comprising steps of: on one side of the lower receiver, providing a threaded fastener having a proximal end and a distal end; threading the threaded fastener into a ratchet handle along a longitudinal axis at the proximal end of the threaded fastener; mounting a ratchet gear into the ratchet handle at the opposite side of the threaded fastener, wherein the threaded fastener passes through an aperture of the ratchet handle and threads into the ratchet gear; positioning a locking plate at the lower receiver, wherein the ratchet handle is attached to the locking plate through the ratchet gear for locking the ratchet handle in a locked position; and on an opposite side of the lower receiver, inserting a pivot pin through an aperture of the locking plate from the opposite side of the lower receiver, wherein a threaded rod of the ratchet gear is threaded into a threaded cavity of the pivot pin.

Embodiments in accordance with the present invention further provide a fixing device for assembling a lower receiver and an upper receiver of a firearm. The device comprising a threaded fastener having a proximal end and a distal end. The device further comprising a ratchet handle comprising a cylindrical portion having a proximal end, a distal end, and a lever, wherein the rachet handle is capable of facilitating tightening and/or loosening of the lower receiver and the upper receiver by rotating the lever. The device further comprising a ratchet gear comprising a plurality of extrusions, wherein the plurality of extrusions are capable of facilitating a restraining of rotation of the ratchet handle. The device further comprising a locking plate comprising a plurality of stop registrations, wherein the plurality of stop registrations are capable of locking the ratchet handle in a locked position by locking the lever of the ratchet handle into one of the plurality of stop registrations. The device further comprising a pivot pin capable of inserting through the lugs of the upper receiver, the lower receiver and an aperture of the locking plate from an opposite side of the lower receiver, wherein a threaded rod of the ratchet gear is threaded into a threading cavity of the pivot pin for tightening and fixing the upper receiver and the lower receiver of the firearm.

Embodiments in accordance with the present invention further provide a firearm fixing system. The system comprising a lower receiver assembly, an upper receiver assembly, and a fixing device for fixing the lower receiver assembly and the upper receiver assembly. The fixing device comprising a threaded fastener having a proximal end and a distal end. The fixing device further comprising a ratchet handle comprising a cylindrical portion having a proximal end, a distal end, and a lever, wherein the rachet handle is capable of facilitating tightening and/or loosening of the lower receiver assembly and the upper receiver assembly by rotating the lever. The fixing device further comprising a ratchet gear comprising a plurality of extrusions, wherein the plurality of extrusions are capable of facilitating a restraining of rotation of the ratchet handle. The fixing device further comprising a locking plate comprising a plurality of stop registrations, wherein the plurality of stop registrations are capable of locking the ratchet handle in a locked position by locking the lever of the ratchet handle into one of the plurality of stop registrations. The fixing device further comprising a pivot pin capable of inserting through the lugs of the upper receiver, the lower receiver and an aperture of the locking plate from an opposite side of the lower receiver, wherein a threaded rod of the ratchet gear is threaded into a threading cavity of the pivot pin for tightening and fixing the upper receiver and the lower receiver of the firearm.

Embodiments of the present invention may provide a number of advantages depending on its particular configuration. In one embodiment of the present invention there is provided a system and method to fix together a lower receiver assembly and an upper receiver assembly of a firearm. Lugs of the lower receiver are compressed against a mating portion of the upper receiver, eliminating the excess movement or "play" associated with the firearms. This further transforms a two-part rifle into a monolithic unit, and thus creating a consistently stable and accurate firearm.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures:

FIGS. 9A-9F illustrate different views of the ratchet gear of the fixing device, according to other embodiments of the present invention disclosed herein;

FIGS. 13A-13H illustrate different views of a locking plate of the fixing device, according to embodiments of the present invention disclosed herein;

Figure 1:
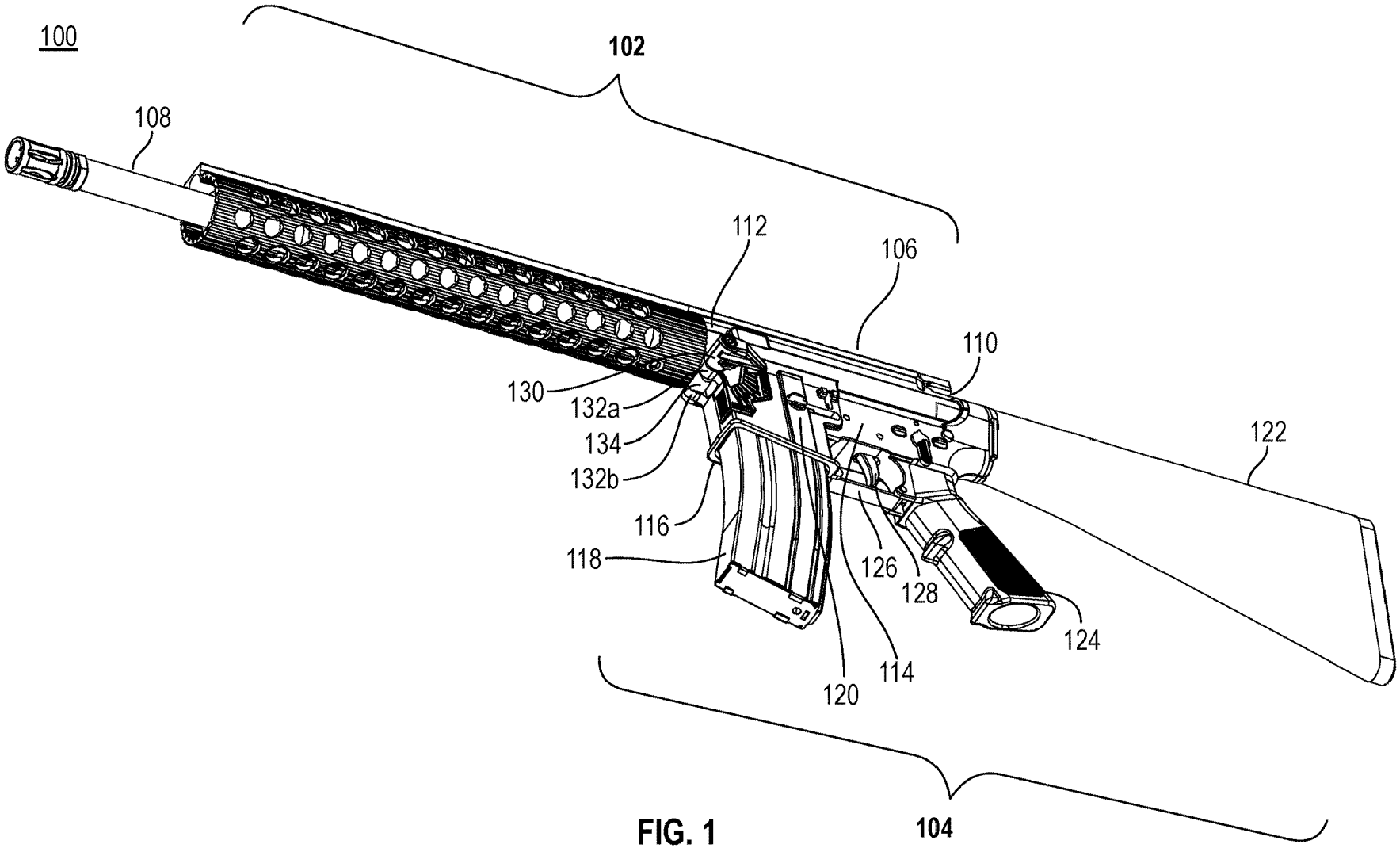
FIG. 1 illustrates a perspective view of a firearm comprising a fixing device, according to embodiments of the present invention disclosed herein.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material".

The term "distal end" refers to a reference position of components indicating away from the firearm.

The term "proximal end" refers to a reference position of components indicating closer to the firearm FIG. 1 illustrates a perspective view of a firearm 100, according to embodiments of the present invention. The firearm 100 is a weapon used for shooting. The firearm 100 may be a portable, short-barreled or long-barreled rifle. In a preferred embodiment of the present invention, the firearm 100 may be an AR10, or an AR15 firearm. The firearm 100 may be an automatic rifle, or a semi-automatic rifle. The firearm 100 comprises an upper receiver assembly 102, and a lower receiver assembly 104, in an embodiment of the present invention.

The upper receiver assembly 102 may comprise various parts of the firearm 100 such as, but not limited to, an upper receiver 106, a barrel 108, a charging handle 110, a bolt carrier group (not shown), a chamber 112, and so forth. The barrel 108 may be a hollow cylindrical structure that is used to receive cartridge or round (not shown). The charging handle 110 may be used to rack the bolt carrier group (not shown) to load and/or unload the cartridge into the chamber 112. After the firing, the bolt carrier group (not shown) may change its position to an unlock position to eject an empty shell after the firing. The upper receiver 106 may also comprise one or more lugs 134 that are capable of assembling the lower receiver assembly 104 to the upper receiver assembly 102.

Further, the lower receiver assembly 104 of the firearm 100 may comprise, but is not limited to, a lower receiver 114, a magazine well 116, a magazine 118, a magazine release button 120, a butt stock 122, a grip 124, and so forth. The magazine well 116 is capable of receiving the magazine 118. The cartridge is then supplied to the chamber 112 of the barrel 108 via the bolt carrier group (not shown) to load the firearm 100 in the load position. The lower receiver 114 of the firearm 100 may release the magazine 118 by pressing the magazine release button 120. In an embodiment of the present invention, the magazine release button 120 may be pressed to remove the magazine 118 from the magazine well 116. In an embodiment of the present invention, a position of the magazine 118 and the cartridge are fixed based on an orientation of the magazine well 116. The butt stock 122 may be used for providing a structural support to a shooter by engaging the shooter's shoulder when firing the firearm 100 during a firing action. The grip 124 may be capable of providing an assistance to the shooter in gripping and holding the firearm 100. In an embodiment of the present invention, the grip 124 may be made up of but not limited to, polymers. Embodiments of the present invention are intended to include or otherwise cover any material for grip, including known, related art, and/or later developed technologies that may be beneficial for a shooter to hold the firearm 100. Further, the lower receiver 114 may comprise two or more lugs 132*a* and 132*b* that may be capable of assembling the upper receiver assembly 102 to the lower receiver assembly 104.

Further, the lower receiver assembly 104 comprises a trigger guard 126 and a trigger 128, in an embodiment of the present invention. The trigger guard 126 may be a closed loop that is used to protect the trigger 128. The trigger 128 is a mechanism for actuating the firing sequence of the firearm 100. The trigger 128 may cause a hammer (not shown) and enabling it to hit a firing pin (not shown) of the firearm 100. The firing pin further causes the detonation of a primer within the cartridge, which ignites the ammunition.

The upper receiver 106 and the lower receiver 114 may be fit together by a fixing device 130, according to an embodiment of the present invention. The fixing device 130 may be explained below in detail.

Figure 2:
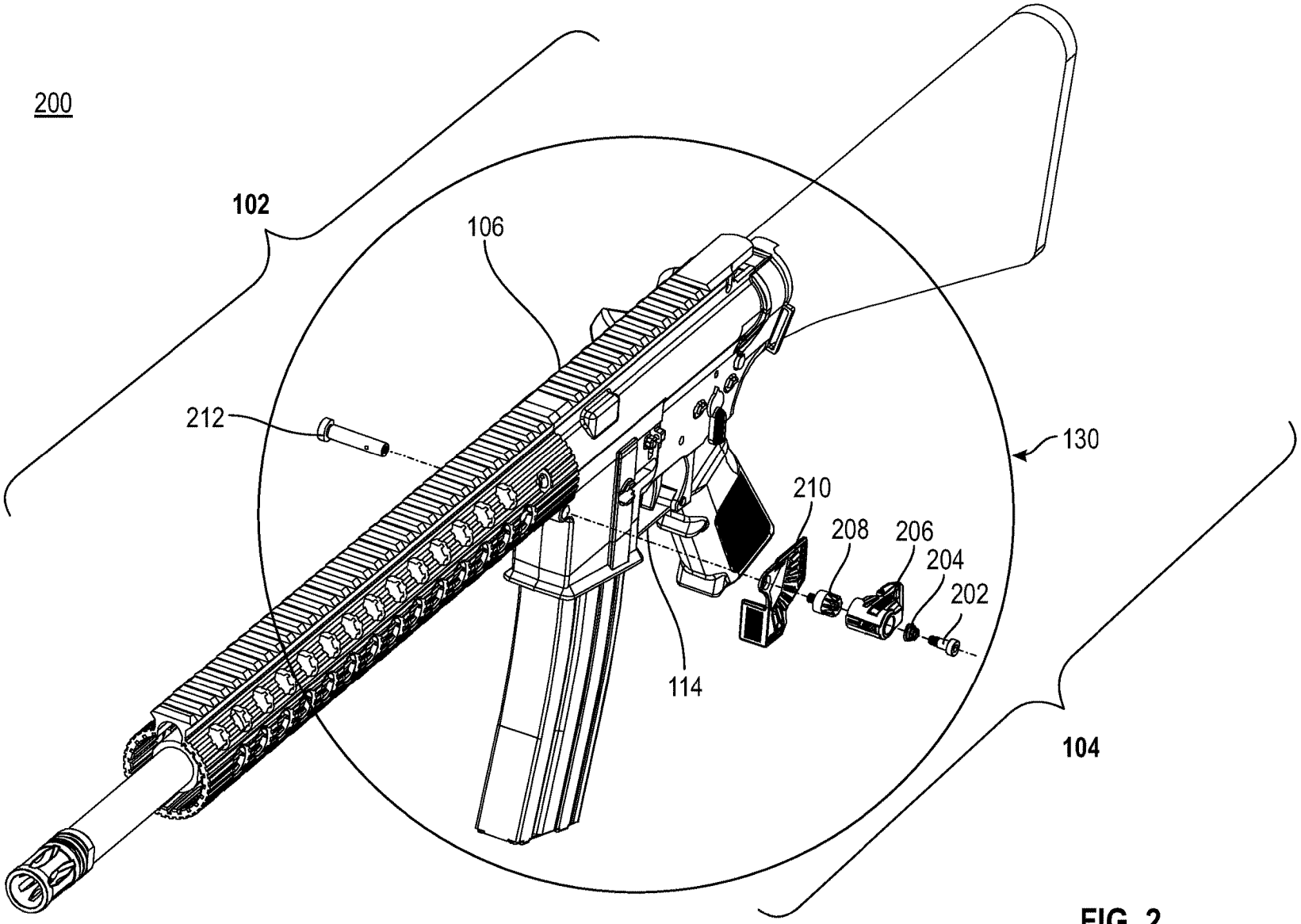
FIG. 2 illustrates a perspective left view of the firearm comprising an exploded perspective view of the fixing device, according to embodiments of the present invention disclosed herein.

FIG. 2 illustrates a perspective, left view of the firearm 100 comprising an exploded perspective view of the fixing device 130, according to embodiments of the present invention. FIG. 2 illustrates an exemplary embodiment 200 in which the fixing device 130 is mounted on the firearm 100 for the purpose of fixing the lower receiver assembly 104 and the upper receiver assembly 102. In an embodiment of the present invention, the fixing device 130 may be used to tighten the lower receiver assembly 104 and the upper receiver assembly 102. In another embodiment of the present invention, the fixing device 130 may be used to loosen the lower receiver assembly 104 and the upper receiver assembly 102.

The fixing device 130 may comprise components such as, but not limited to, a threaded fastener 202, a spring 204, a ratchet handle 206, a ratchet gear 208, a locking plate 210, and a pivot pin 212. On one side of the firearm 100, the components of the fixing device 130 are in an order of the threaded fastener 202, the spring 204, the ratchet handle 206, the ratchet gear 208, and the locking plate 210. On the opposite side of the firearm 100, the pivot pin 212 of the fixing device 130 is positioned. The order of assembly and functioning of the fixing device 130 is explained in detail in conjunction with FIG. 3.

Figure 3:
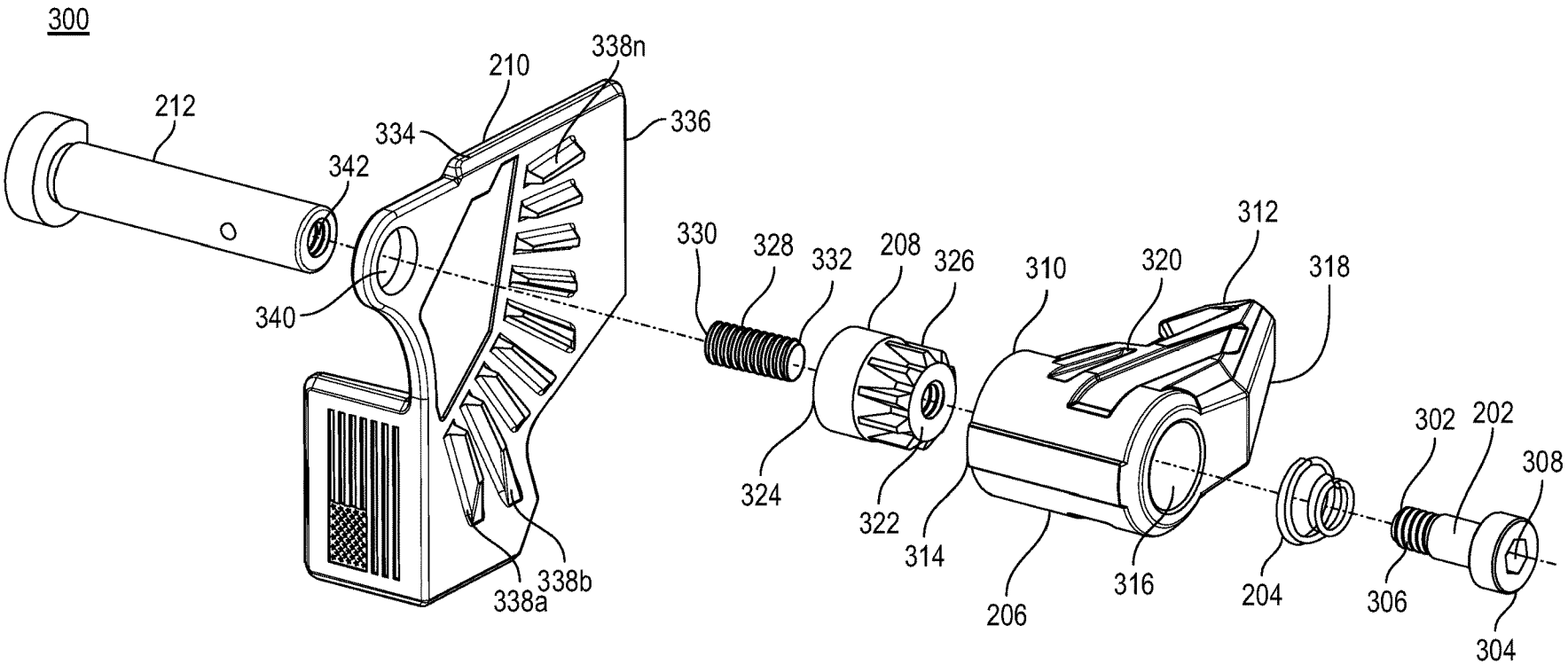
FIG. 3 illustrates a front, right side exploded perspective view of the fixing device, according to embodiments of the present invention disclosed herein.

FIG. 3 illustrates a front, right side exploded, perspective view of the fixing device 130, according to embodiments of the present invention. The threaded fastener 202 having a proximal end 302 and a distal end 304. The proximal end 302 of the threaded fastener 202 may comprise a threaded portion 306 that is capable of receiving and meshing with the ratchet gear 208. The distal end 304 of the threaded fastener 202 may include a head 308 that may be used for tightening and/or loosening the threaded fastener 202. In an embodiment of the present invention, the head 308 of the threaded fastener 202 may be, but not limited to, a flat head, a pan head, an oval head, a round head, and so forth. In an embodiment of the present invention, the head 308 of the threaded fastener 202 may be in a hexagon shape. Embodiments of the present invention are intended to include or otherwise cover any type and/or shape of the head 308, including known, related art, and/or later developed technologies that may be beneficial for providing a grip to a tool for tightening and/or loosening the upper receiver assembly 102 and the lower receiver assembly 104. The threaded fastener 202 is further capable of receiving the spring 204 at the proximal end 302 of the threaded fastener 202, in an embodiment of the present invention. The spring 204 may be for example, but not limited to, a disc spring, at least two opposing flat springs, a spring plate, a coil spring, or a conical spring. Embodiments of the present invention are intended to include or otherwise cover any type of spring, including known, related art, and/or later developed technologies.

The fixing device 130 further comprising the ratchet handle 206, in an embodiment of the present invention. In an embodiment of the present invention, the ratchet handle 206 may be a threaded fastener ratchet handle as shown in FIGS. 7A-7F. The ratchet handle 206 may comprise a cylindrical portion 310 and a lever 312. The cylindrical portion 310 having a proximal end 314 and a distal end 316. The ratchet handle 206 is capable of accepting the threaded fastener 202 along with the spring 204 at the distal end 316 of the cylindrical portion 310, in an embodiment of the present invention. The proximal end 314 of the cylindrical portion 310 may comprise a meshing structure 720 as shown in FIG. 7E. The proximal end 314 of the cylindrical portion 310 may be capable of accepting and meshing with plurality of extrusions 326, as discussed below, circumscribing the distal end 322 of the ratchet gear 208, in an embodiment of the present invention. The lever 312 of the ratchet handle 206 may be rotated to fix the upper receiver assembly 102 and lower receiver assembly 104. In an embodiment of the present invention, the lever 312 having a proximal end 320 and a distal end 318.

Further, the fixing device 130 comprises the ratchet gear 208, in an embodiment of the present invention. The ratchet gear 208 may be rotatably mounted and inserted into the proximal end 314 of the ratchet handle's 206 cylindrical portion 310. The ratchet gear 208 having a distal end 322 and a proximal end 324. In an embodiment of the present invention, the ratchet gear 208 may include a plurality of extrusions 326 circumscribing the circumference of the distal end 322 of the ratchet gear 208. The extrusions 326 may be capable to facilitate restraining the rotation of the ratchet handle 206. The extrusions 326 are capable of meshing with the ratchet handle 206 at the proximal end 314 of the cylindrical portion 310, in an embodiment of the present invention. Further, the ratchet gear 208 comprises a threaded longitudinal aperture. The threaded longitudinal aperture is capable of receiving the threaded proximal end 302 of the threaded fastener 202, which therefore mounts the ratchet gear 208 into the ratchet handle 206.

The proximal end 324 of the ratchet gear 208 may include a threaded rod 328, in an embodiment of the present invention. In an embodiment of the present invention, the threaded rod 328 may be temporarily integrated with the ratchet gear 208. The threaded rod 328 may be a male threaded rod, in an embodiment of the present invention. Embodiments of the present invention are intended to include or otherwise cover any type of the threaded rod, including known, related art, and/or later developed technologies. The threaded rod 328 comprising a proximal end 330 and a distal end 332, in an embodiment of the present invention. The proximal end 330 of the threaded rod 328 is inserted in the pivot pin 212 and the distal end 332 of the threaded rod 328 is inserted in the ratchet gear 208, in an embodiment of the present invention.

Further, the fixing device 130 comprises a locking plate 210, in an embodiment of the present invention. The locking plate 210 comprises a proximal end 334 and a distal end 336. In an embodiment of the present invention, the distal end 336 of the locking plate 210 comprises a plurality of positive stop registrations 338*a*-338*n* (hereinafter referred to as the positive stop registration 338). In an embodiment of the present invention, the positive stop registration 338 may be protruded. The positive stop registration 338 may be capable of engaging with the lever 312 of the ratchet handle 206. In an exemplary embodiment of the present invention, when the firearm 100 is in a disengaged gear position, the ratchet handle 206 may be able to turn freely to a new desired position. Further, the lever 312 may engage with the positive stop registrations 338 at the new desired position to prevent loosening of the fixing device 130 and lock the upper receiver assembly 102 and the lower receiver assembly 104 of the firearm 100. In an embodiment of the present invention, the locking plate 210 may be capable of providing a protection to the firearm 100 against, but not limited to, marring, scratching, and binding being caused during tightening and/or loosening upper receiver assembly 102 and the lower receiver assembly 104 of the firearm 100. In an embodiment of the present invention, the locking plate 210 comprises an aperture 340.

Further, the fixing device 130 comprises the pivot pin 212, in an embodiment of the present invention. The pivot pin 212 may be capable of accepting the threaded rod 328 of the ratchet gear 208 through the aperture 340 of the locking plate 210. In an embodiment of the present invention, the pivot pin 212 may comprise a threaded cavity 342 to accept the threaded rod 328 of the ratchet gear 208.

Figure 4A:
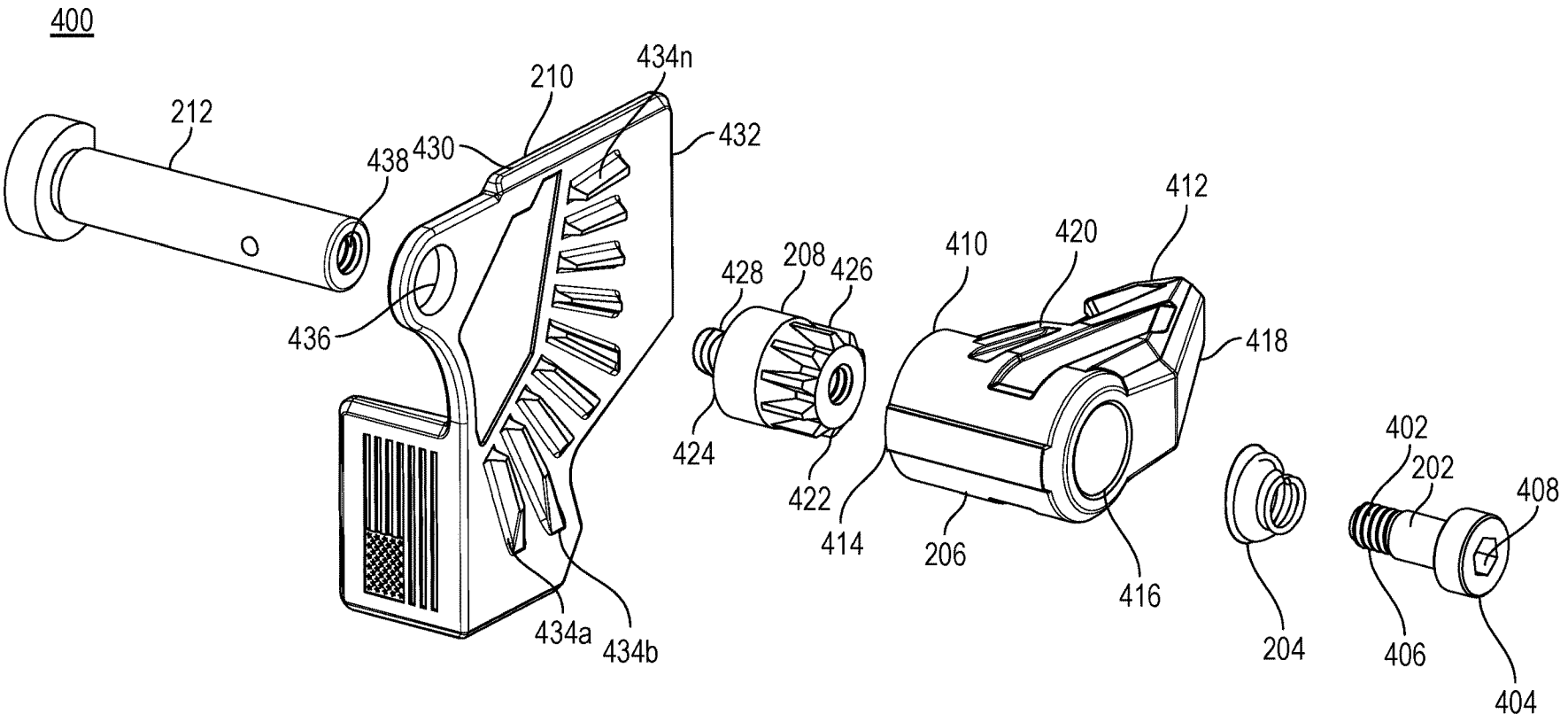
FIG. 4A illustrates a front, right side exploded perspective view of the fixing device, according to other embodiments of the present invention disclosed herein.

FIG. 4A illustrates a front, right side exploded, perspective view of the fixing device 130, according to an alternate embodiment of the present invention. The threaded fastener 202 having a proximal end 402 and a distal end 404. The proximal end 402 of the threaded fastener 202 may comprise a threaded portion 406 that is capable of receiving and meshing with the ratchet gear 208. The distal end 404 of the threaded fastener 202 may include a head 408 that may be used for tightening and/or loosening the threaded fastener 202. As discussed above, in an embodiment of the present invention, the head 408 of the threaded fastener 202 may be, but not limited to, a flat head, a pan head, an oval head, a round head, and so forth. In an embodiment of the present invention, the head 408 of the threaded fastener 202 may be in a hexagon shape. Embodiments of the present invention are intended to include or otherwise cover any type and/or shape of the head 408, including known, related art, and/or later developed technologies that may be beneficial for providing a grip to a tool for tightening and/or loosening the upper receiver assembly 102 and the lower receiver assembly 104 of the firearm 100. The threaded fastener 202 is further capable of receiving the spring 204 at the proximal end 402 of the threaded fastener 202, in an embodiment of the present invention. The spring 204 may be for example, but not limited to, a disc spring, at least two opposing flat springs, a spring plate, a coil spring, or a conical spring. Embodiments of the present invention are intended to include or otherwise cover any type of spring, including known, related art, and/or later developed technologies.

The fixing device 130 further comprising the ratchet handle 206, in an embodiment of the present invention. The ratchet handle 206 may comprise a cylindrical portion 410 and a lever 412. The cylindrical portion 410 having a proximal end 414 and a distal end 416. The ratchet handle 206 is capable of accepting the threaded fastener 202 along with the spring 204 at the distal end 416 of the cylindrical portion 410, in an embodiment of the present invention. The proximal end 414 of the cylindrical portion 410 may comprise a meshing structure 720 as shown in FIG. 7E. The proximal end 414 of the cylindrical portion 410 may be capable of accepting and meshing with the plurality of extrusions 426, as discussed below, circumscribing the distal end 422 of the ratchet gear 208, in an embodiment of the present invention. The lever 412 of the ratchet handle 206 may be rotated in a clockwise or anti-clockwise direction to fix the upper receiver assembly 102 and lower receiver assembly 104. In an embodiment of the present invention, the lever 412 having a proximal end 420 and a distal end 418.

Further, the fixing device 130 comprises the ratchet gear 208, in an embodiment of the present invention. The ratchet gear 208 may be rotatably mounted and inserted into the proximal end 414 of the ratchet handle's 206 cylindrical portion 410. The ratchet gear 208 having a distal end 422 and a proximal end 424. In an embodiment of the present invention, the ratchet gear 208 may include a plurality of extrusions 426 circumscribing the circumference of the distal end 422 of the ratchet gear 208. The extrusions 426 may be capable to facilitate restraining the rotation of the ratchet handle 206. The extrusions 426 are capable of meshing with the ratchet handle 206 at the proximal end 414 of the cylindrical portion 410 of the ratchet handle 206, in an embodiment of the present invention. Further, the ratchet gear 208 comprises a threaded longitudinal aperture. The threaded longitudinal aperture is capable of receiving the threaded proximal end 402 of the threaded fastener 202, which therefore mounts the ratchet gear 208 into the ratchet handle 206.

The proximal end 424 of the ratchet gear 208 may include a threaded rod 428 integrated into the ratchet gear 208 as a single component, in an embodiment of the present invention. The threaded rod 428 may be a male threaded rod, in an embodiment of the present invention. Embodiments of the present invention are intended to include or otherwise cover any type of a threaded rod, including known, related art, and/or later developed technologies.

Further, the fixing device 130 comprises the locking plate 210, in an embodiment of the present invention. The locking plate 210 comprises a proximal end 430 and a distal end 432. In an embodiment of the present invention, the distal end 432 of the locking plate 210 comprises a plurality of positive stop registrations 434*a*-434*n* (hereinafter referred to as the positive stop registration 434). In an embodiment of the present invention, the positive stop registration 434 may be protruded. The positive stop registration 434 may be capable of engaging with the lever 412 of the ratchet handle 206. In an exemplary embodiment of the present invention, when the firearm 100 is in a disengaged gear position, the ratchet handle 206 may be able to turn freely to a new desired position and when a desired position is achieved, the lever 412 gets engaged between the two positive stop registration 434 in an engaged gear position to prevent loosening of the fixing device 130 and lock the upper receiver assembly 102 and the lower receiver assembly 104 of the firearm 100. In an embodiment of the present invention, the locking plate 210 may be capable of providing a protection to the firearm 100 against, but not limited to, marring, scratching, and binding being caused during tightening and/or loosening the upper receiver assembly 102 and the lower receiver assembly 104 of the firearm 100. In an embodiment of the present invention, the locking plate 210 comprises an aperture 436.

Further, the fixing device 130 comprises the pivot pin 212, in an embodiment of the present invention. The pivot pin 212 may be capable of accepting the threaded rod 428 of the ratchet gear 208 through the aperture 436 of the locking plate 210. In an embodiment of the present invention, the pivot pin 212 may comprise a threaded cavity 438 to accept the threaded rod 428 of the ratchet gear 208.

Figure 4C:
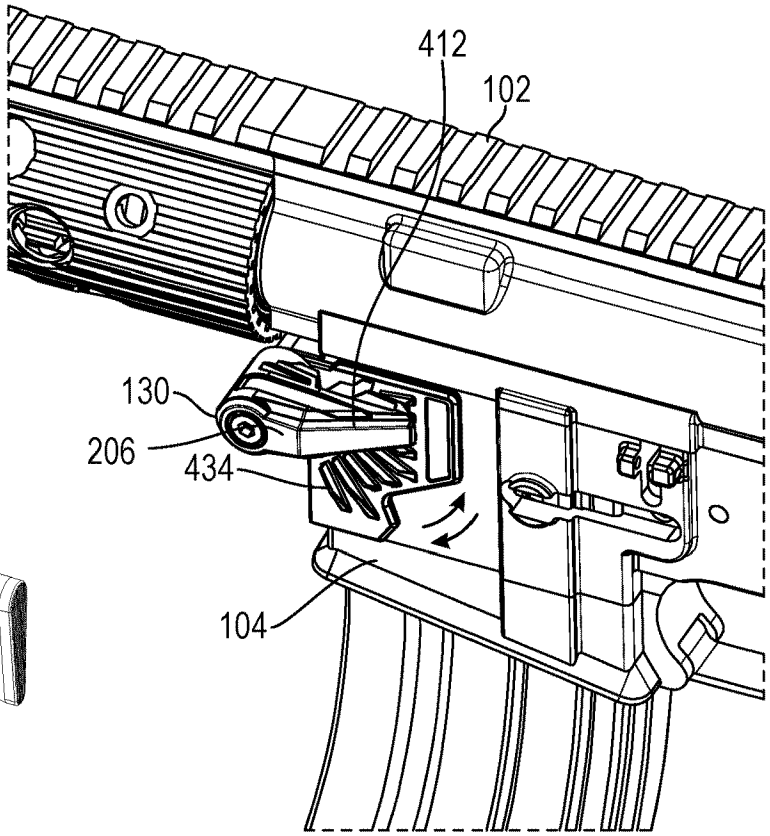
FIG. 4C illustrates an enhanced perspective view of the firearm depicting the fixing device assembled on the firearm, according to embodiments of the present invention disclosed herein.
Figure 4B:
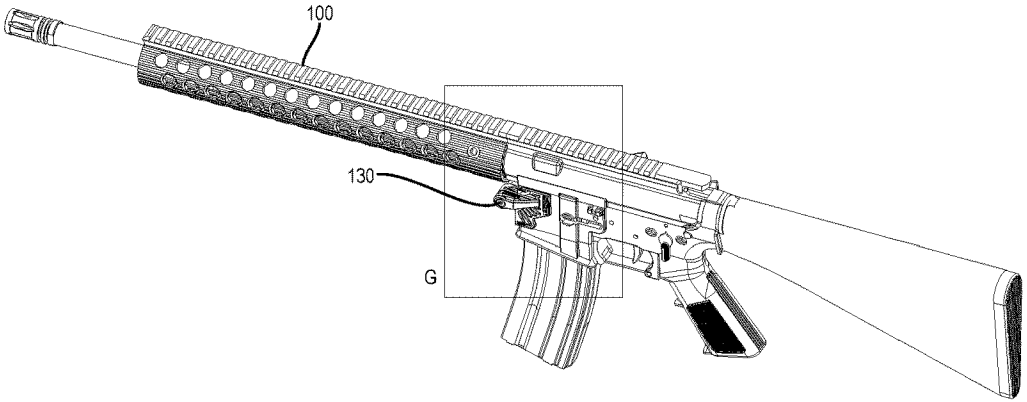
FIG. 4B illustrates a side perspective view of a firearm, depicting the fixing device assembled on the firearm, according to embodiments of the present invention disclosed herein.

FIG. 4B illustrates a side perspective view of a firearm 100 depicting the fixing device 130 assembled on the firearm 100, according to embodiments of the present invention.

FIG. 4C illustrates an enhanced perspective view of the firearm 100 depicting the fixing device 130 assembled on the firearm 100 as shown in the FIG. 4B, according to embodiments of the present invention. In an exemplary embodiment of the present invention, a user may desire to tighten the upper receiver assembly 102 and the lower receiver assembly 104 of the firearm. The user may then pull the ratchet handle 206 in a parallel axis to the length of the pivot pin 212 (not shown) to achieve a disengaged gear position. The ratchet handle 206 is then rotated with the help of the lever 412 in a clockwise or anti-clockwise direction from a current position of the ratchet handle 206 to the desired tightening start position. The ratchet handle 206 may then be released to reseat in the engaged gear position. The user may then tighten the ratchet handle 206 by rotating the ratchet handle 206 with the help of the lever 412 in a clockwise direction from the current position, to tighten and lock the fixing device 130 and ultimately the upper receiver assembly 102 and the lower receiver assembly 104 of the firearm 100. The lever 412 may again be pulled into the disengaged gear position allowing the ratchet handle 206 to turn freely in a clockwise or anti-clockwise direction to achieve the desired position. The lever of the ratchet handle 206 is then released, which gets engaged with positive stop registrations 434 of the locking plate 210 in an engaged gear position to prevent loosening of the fixing device 130 and maintain locking of the upper receiver assembly 102 and the lower receiver assembly 104 of the firearm 100. Further, if the user desires to loosen the upper receiver assembly 102 and the lower receiver assembly 104, then the user may pull the ratchet handle 206 in the parallel axis to the length of the pivot pin 212 to achieve the disengaged gear position. The ratchet handle 206 is then rotated with the help of the lever 412 in a clockwise or anti-clockwise direction from a current position of the ratchet handle 206 to the desired loosening start position. The ratchet handle 206 may then be released to reseat in the engaged gear position. The ratchet handle 206 may then be rotated in the anti-clockwise direction to loosen the fixing device 130 and ultimately the upper receiver assembly 102 and the lower receiver assembly 104.

Figure 5A:
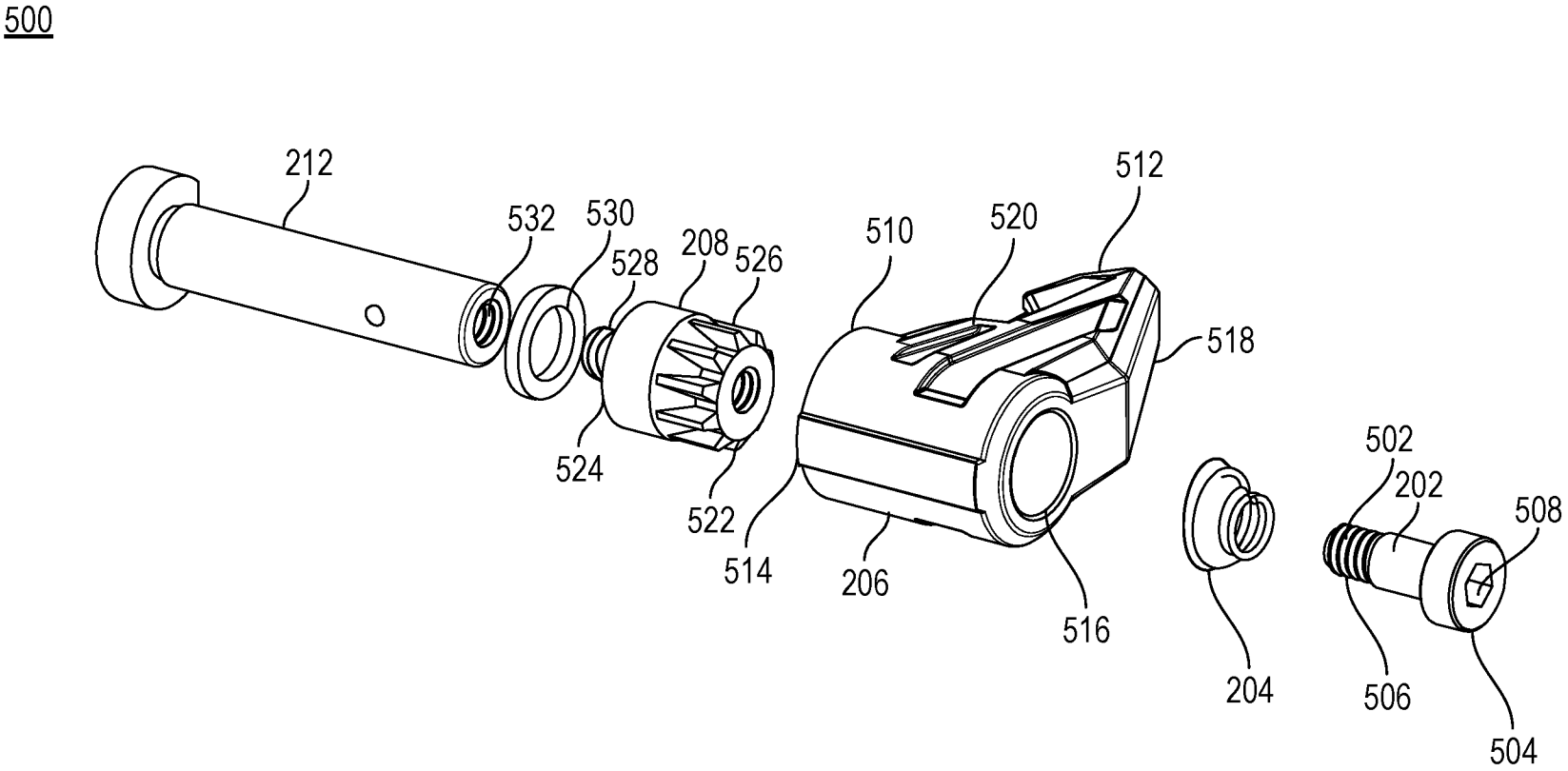
FIG. 5A illustrates a front, right side exploded perspective view of the fixing device, according to other embodiments of the present invention disclosed herein.

FIG. 5A illustrates a front, right side exploded, perspective view of the fixing device 500, according to an alternate embodiment of the present invention. The fixing device 500 comprises the threaded fastener 202 having a proximal end 502 and a distal end 504. The proximal end 502 of the threaded fastener 202 may comprise a threaded portion 506 capable of receiving the ratchet gear 208. The distal end 504 of the threaded fastener 202 may include a head 508 that may be used for tightening and/or loosening the threaded fastener 202 and the ratchet gear 208. Embodiments of the present invention are intended to include or otherwise cover any type and/or shape of the head 508, including known, related art, and/or later developed technologies that may be beneficial for providing a grip to a tool for tightening and/or loosening the fixing device 500. The threaded fastener 202 is further capable of receiving the spring 204 at the proximal end 502 of the threaded fastener 202, in an embodiment of the present invention. As discussed above, the spring 204 may be for example, but not limited to, a disc spring, at least two opposing flat springs, a spring plate, a coil spring, or a conical spring. Embodiments of the present invention are intended to include or otherwise cover any type of spring, including known, related art, and/or later developed technologies.

The fixing device 500 further comprising the ratchet handle 206, in an embodiment of the present invention. The ratchet handle 206 may comprise a cylindrical portion 510 and a lever 512. The cylindrical portion 510 having a proximal end 514 and a distal end 516. The ratchet handle 206 is capable of accepting the threaded fastener 202 along with the spring 204 at the distal end 516 of the cylindrical portion 510, in an embodiment of the present invention. The proximal end 514 of the cylindrical portion 510 may comprise a meshing structure 720 as shown in FIG. 7E and may be capable of accepting and meshing with the plurality of extrusions 526 circumscribing the distal end 522 of the ratchet gear 208, in an embodiment of the present invention. The lever 512 of the ratchet handle 206 may be rotated to fix the upper receiver assembly 102 and lower receiver assembly 104. In an embodiment of the present invention, the lever 512 having a proximal end 520 and a distal end 518.

Further, the fixing device 500 comprises the ratchet gear 208, in an embodiment of the present invention. The ratchet gear 208 may be rotatably mounted and inserted into the proximal end 514 of the ratchet handle's 206 cylindrical portion 510. The ratchet gear 208 having a distal end 522 and a proximal end 524. In an embodiment of the present invention, the ratchet gear 208 may include a plurality of extrusions 526 circumscribing the circumference of the distal end 522 of the ratchet gear 208. The extrusions 526 may be capable to facilitate restraining the rotation of the ratchet handle 206, in an embodiment of the present invention. The extrusions 526 are capable of meshing with the ratchet handle 206 at the proximal end 514 of the cylindrical portion 510, in an embodiment of the present invention. Further, the ratchet gear 208 comprises a threaded longitudinal aperture. The threaded longitudinal aperture is capable of receiving the threaded proximal end 502 of the threaded fastener 202, which therefore mounts the ratchet gear 208 into the ratchet handle 206.

Further, the proximal end 524 of the ratchet gear 208 may include a threaded rod 528 integrated into the ratchet gear 208 as a single component, in an embodiment of the present invention. The threaded rod 528 may be a male threaded rod, in an embodiment of the present invention. Embodiments of the present invention are intended to include or otherwise cover any type of the threaded rod, including known, related art, and/or later developed technologies. Further, the fixing device 500 comprises a washer 530 and a pivot pin 212, in an embodiment of the present invention. The pivot pin 212 may be capable of accepting the threaded rod 528 of the ratchet gear 208 through an aperture of the washer 530. In an embodiment of the present invention, the pivot pin 212 may comprise a threaded cavity 532 to accept the threaded rod 528 of the ratchet gear 208.

Figure 5B:
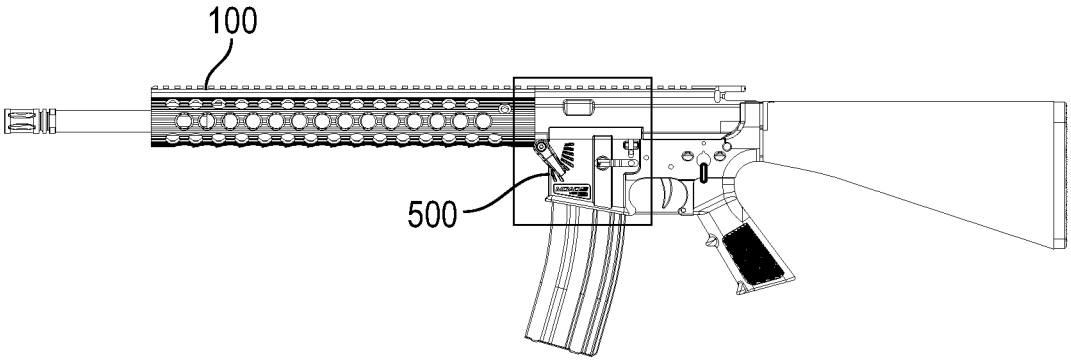
FIG. 5B illustrates a right side orthographic view of a firearm having an assembled the fixing device as shown in the FIG. 5A, according to other embodiments of the present invention disclosed herein.

FIG. 5B illustrates a right side orthographic view of a firearm 100 depicting the fixing device 500 assembled on the firearm 100, according to an alternate embodiment of the present invention.

Figure 5C:
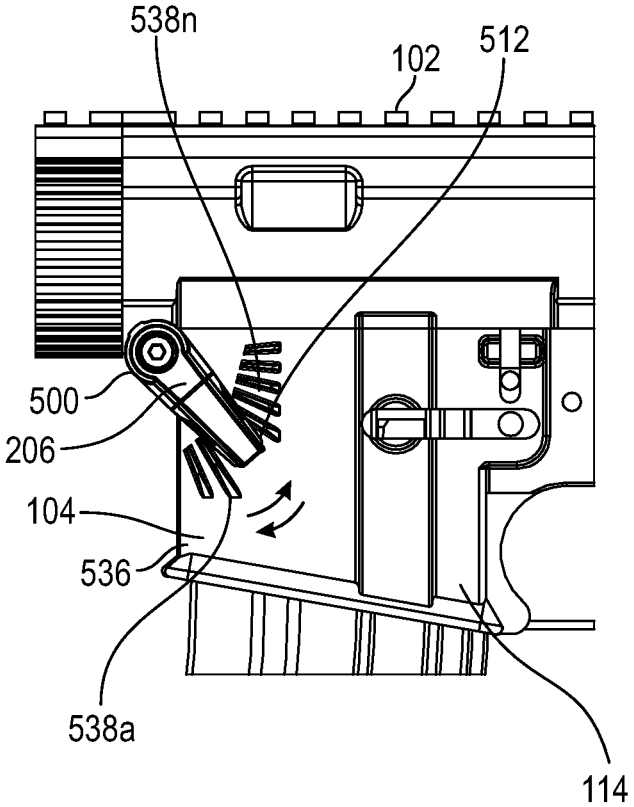
FIG. 5C illustrates an enhanced right side orthographic view of the firearm comprising the fixing device as shown in the FIG. 5B disposed on the firearm, according to embodiments of the present invention disclosed herein.

FIG. 5C illustrates an enhanced right side orthographic view of the firearm 100 of the FIG. 5B depicting the fixing device 500 assembled on the firearm 100, according to an alternate embodiment of the present invention. A magazine well 536 of the lower receiver 114 of the firearm 100 may comprise a plurality of positive stop registrations 538*a*-538*n* (hereinafter referred to as positive stop registration 538). In an embodiment of the present invention, the positive stop registration 538 may be protruded on the surface of the magazine well 536. The positive stop registration 538 may be capable of engaging with the lever 512 of the ratchet handle 206. The ratchet handle 206 may be pulled in a parallel axis to the length of the pivot pin 212 (not shown) to achieve a disengaged gear position. The ratchet handle 206 is then rotated with the help of the lever 512 in a clockwise or anti-clockwise direction from a current position of the ratchet handle 206 to the desired tightening start position. The ratchet handle 206 may then be released to reseat in the engaged gear position. The user may then tighten the ratchet handle 206 by rotating the ratchet handle 206 with the help of the lever 512 in a clockwise direction from the current position, to tighten and lock the fixing device 500 and ultimately the upper receiver assembly 102 and the lower receiver assembly 104 of the firearm 100. The lever 512 may again be pulled into a disengaged gear position allowing the ratchet handle 206 to turn freely in a clockwise or anti-clockwise direction to achieve a desired position. The lever 512 of the ratchet handle 206 is then released into the engaged gear position, which simultaneously engages the positive stop registrations 534 of the magazine well 536 to prevent loosening of the fixing device 500 and maintain locking of the upper receiver assembly 102 and the lower receiver assembly 104 of the firearm 100. Further, if the user desires to loosen the upper receiver assembly 102 and the lower receiver assembly 104, then the user may pull the ratchet handle 206 in the parallel axis to the length of the pivot pin 212 to achieve the disengaged gear position. The ratchet handle 206 may then be rotated with the help of the lever 512 in a clockwise or anti-clockwise direction from a current position of the ratchet handle 206 to the desired loosening start position. The ratchet handle 206 may then be released to reseat in the engaged gear position. Further, the ratchet handle 206 may be rotated in the anti-clockwise direction to loosen the fixing device 500 and ultimately the upper receiver assembly 102 and the lower receiver assembly 104.

Figure 6A:
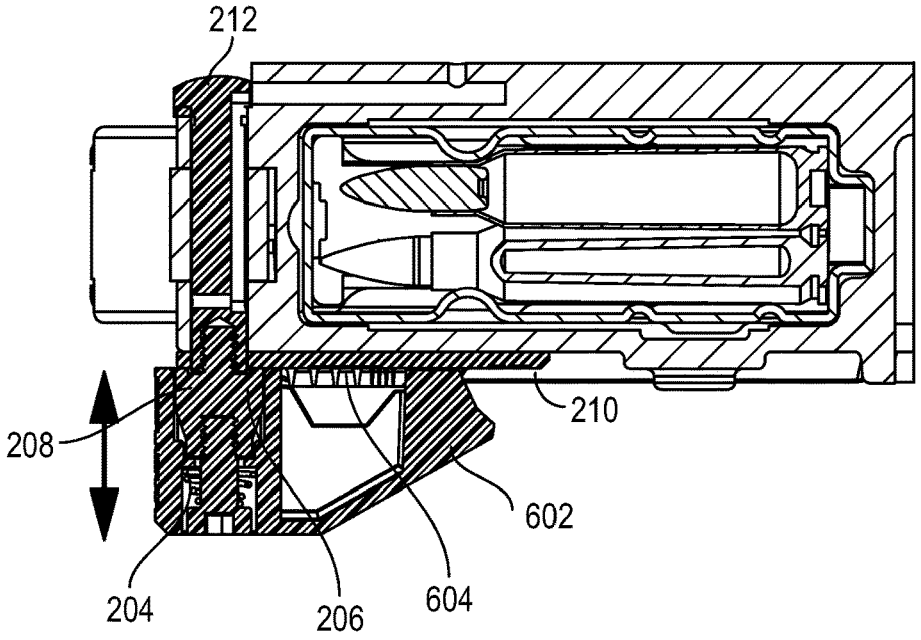
FIG. 6A illustrates a cross-sectional top view of the firearm with the assembled fixing device having a ratchet handle in its fully seated engaged gear position, according to embodiments of the present invention disclosed herein.

FIG. 6A illustrates a cross-sectional, top view of the firearm 100 comprising the fixing device 130 with the ratchet handle 206 in its fully seated engaged gear position, according to embodiments of the present invention. A lever 602 of the ratchet handle 206 may be engaged into positive stop registrations 604 on the locking plate 210. The fully seated position may be defined as a state in which the spring 204 is in a fully expanded position and the ratchet handle 206 is in the engaged gear position with the ratchet gear 208. In this fully seated position, the lever 602 of the ratchet handle 206 may be able to rotate in a clockwise or anti-clockwise direction for tightening or loosening of the fixing device 130 and ultimately the upper receiver assembly 102 and the lower receiver assembly 104 of the firearm 100. Further, in the fully seated position, the lever 602 of the fixing device 130 may be located and locked into the positive stop registrations 604 of the locking plate 210.

Figure 6B:
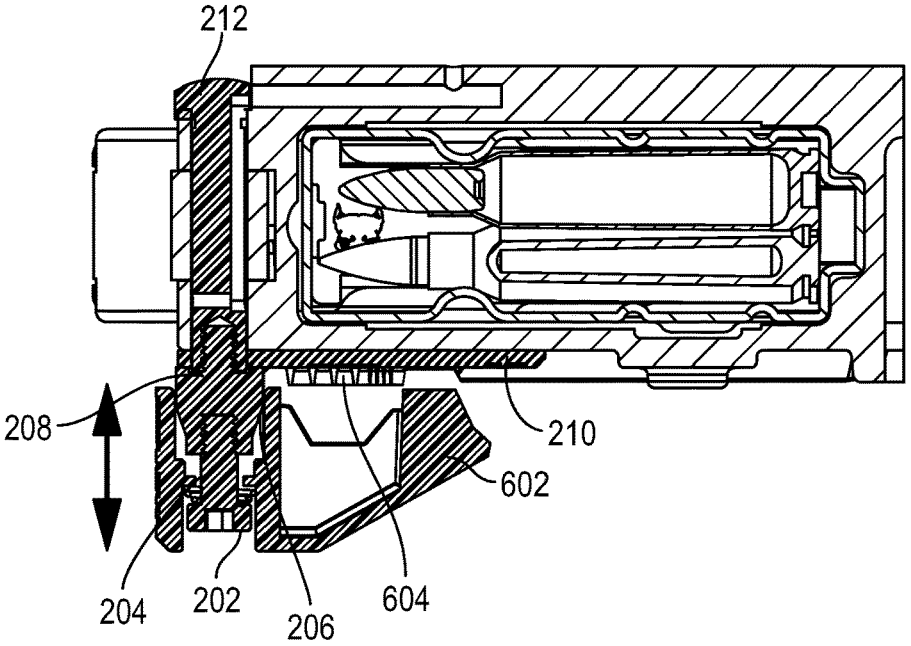
FIG. 6B illustrates a cross-sectional top view of the firearm with the assembled fixing device having the ratchet handle in its disengaged gear position, according to embodiments of the present invention disclosed herein.

FIG. 6B illustrates a cross-sectional, top view of the firearm 100 comprising the fixing device 130 with the ratchet handle 206 in its disengaged gear position, according to embodiments of the present invention. The disengaged gear position may be defined wherein the ratchet handle 206 is pulled in a parallel axis to the length of the pivot pin 212 and away from the face of the locking plate 210, compressing the spring 204 of the fixing device 130. This further disengages the lever 602 of the ratchet handle 206 from the positive stop registrations 604 of the locking plate 210. In the disengaged gear position, the ratchet handle 206 may be able to freely rotate in a clockwise or anti-clockwise direction to achieve a desired new position before releasing into the fully seated engaged gear position for further tightening, loosening or locking into the locking plate 210.

Figure 7B:
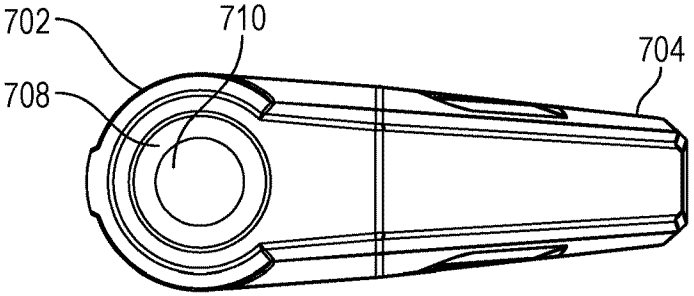
FIGS. 7A-7F illustrate different views of the ratchet handle of the fixing device, according to embodiments of the present invention disclosed herein.
Figure 7D:
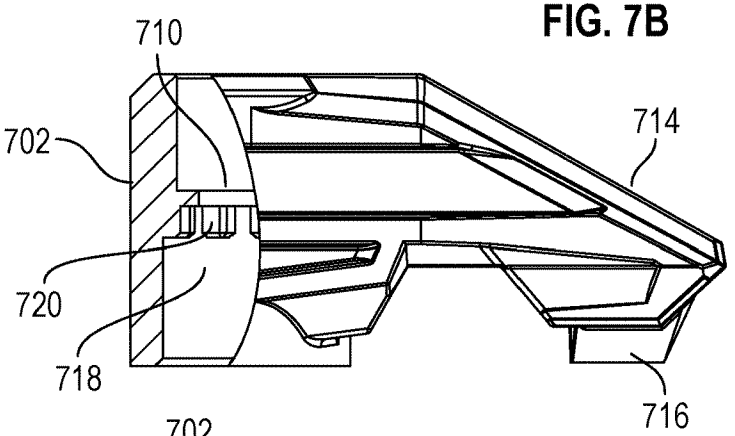
Figure 7E:
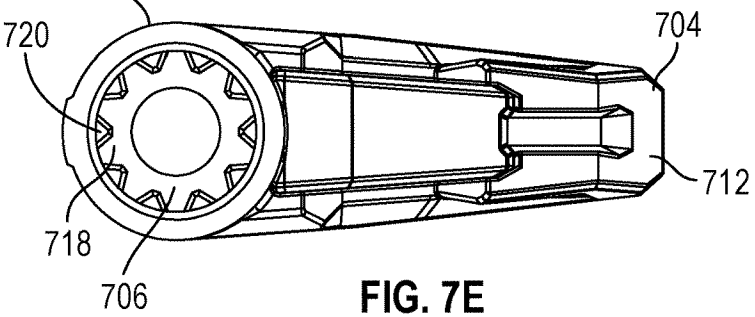
Figure 7F:
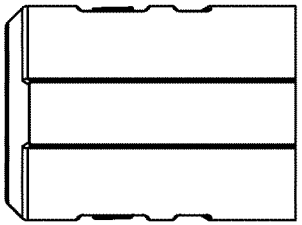
Figure 7A:
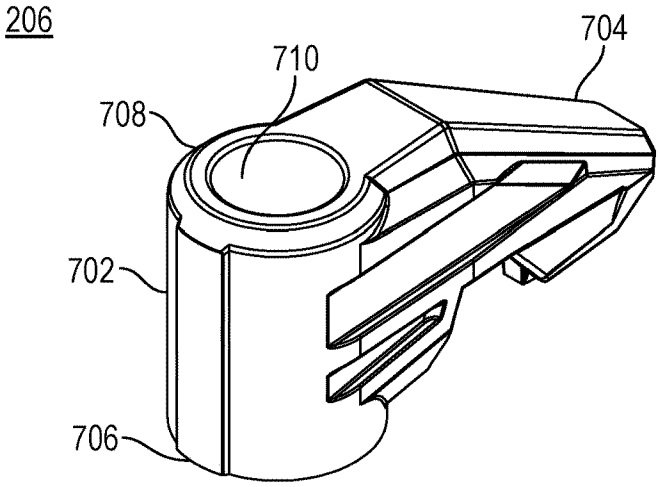

FIGS. 7A-7F illustrate different views of the ratchet handle 206 of the fixing device 130, according to embodiments of the present invention. FIG. 7A illustrates a front perspective view of the ratchet handle 206, in an embodiment of the present invention. The ratchet handle 206 comprises a cylindrical portion 702, and a lever 704. Further, the cylindrical portion 702 may comprise a proximal end 706 and a distal end 708. The distal end 708 may comprise an opening 710 for accepting the threaded fastener 202 (not shown) of the fixing device 130, in an embodiment of the present invention.

FIG. 7B illustrates a top view of the ratchet handle 206, in an embodiment of the present invention. FIG. 7B illustrates the cylindrical portion 702 and the lever 704 of the ratchet handle 206. The distal end 708 of the cylindrical portion 702 comprises the opening 710 for accepting the threaded fastener 202 (not shown). The width of the ratchet handle 206 at the end near to the cylindrical portion 702 may be larger than the width at the end near to the lever 704, in an embodiment of the present invention.

Figure 7C:
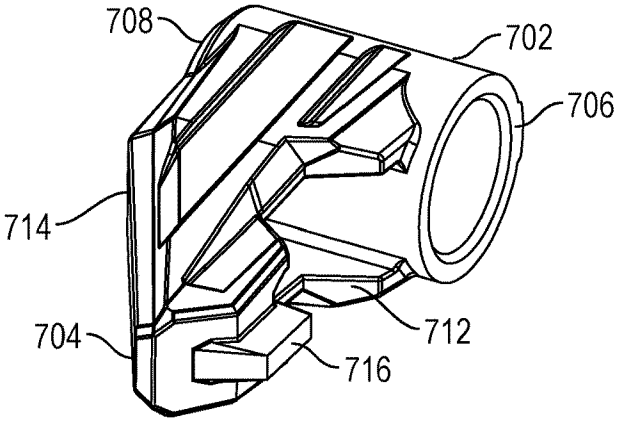

FIG. 7C illustrates a rear perspective view of the ratchet handle 206, in an embodiment of the present invention. As discussed above, the ratchet handle 206 comprises the cylindrical portion 702 and the lever 704. Further, the lever 704 comprises a proximal end 712 and a distal end 714. The proximal end 712 of the lever 704 comprises a cored structure with a locking tenon 716. The locking tenon 716 may be capable of engaging the ratchet handle 206 within the positive stop registrations 434 present on the distal end 432 of the locking plate 210 (as shown in the FIG. 4A).

FIG. 7D illustrates a side view of the ratchet handle 206 illustrating the locking tenon 716 of the lever 704, in an embodiment of the present invention. FIG. 7D further illustrates a partial cross-sectional side view of the cylindrical portion 702 of the ratchet handle 206, depicting the distal end 708 of the cylindrical portion 702, which may comprise an opening 710 for accepting the threaded fastener 202 (not shown) of the fixing device 130, in an embodiment of the present invention. Further, the cylindrical portion 702 may comprise an opening 718 at the proximal end 706 for accepting the extrusions 326 of the ratchet gear 208 (not shown). The opening 718 may comprise a meshing structure 720 that may be utilized to engage the plurality of extrusions 326 of the ratchet gear 208 (not shown).

FIG. 7E illustrates a bottom view of the ratchet handle 206, in an embodiment of the present invention. The ratchet handle 206 comprises the cylindrical portion 702 and the lever 704. The cylindrical portion 702 may comprise the proximal end 706 and the distal end 708. Further, the proximal end 706 may comprise an opening 718 for accepting the extrusions 326 of the ratchet gear 208 (not shown). The opening 718 may comprise a meshing structure 720 that may be utilized to engage the plurality of extrusions 326 of the ratchet gear 208 (not shown). The lever 704 comprises a proximal end 712 and a distal end 714 (not shown). The proximal end 712 comprises a cored structure with the locking tenon 716. The locking tenon 716 may be utilized in engaging the ratchet handle 206 within the positive stop registrations 434 present on the distal end 432 of the locking plate 210 (as shown in FIG. 4A). Further, FIG. 7F illustrates a rear, side view of the ratchet handle 206, in an embodiment of the present invention.

Figure 8A:
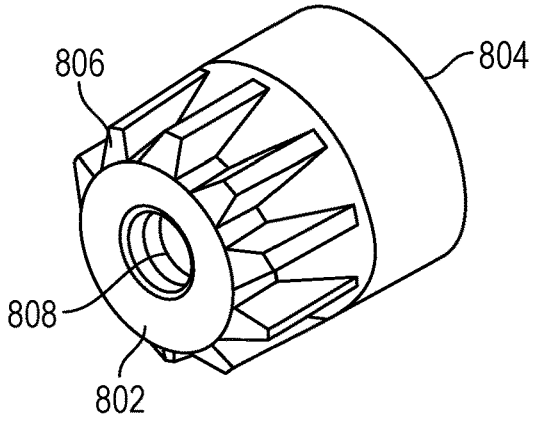
FIGS. 8A-8F illustrate different views of a ratchet gear of the fixing device, according to embodiments of the present invention disclosed herein.
Figure 8B:
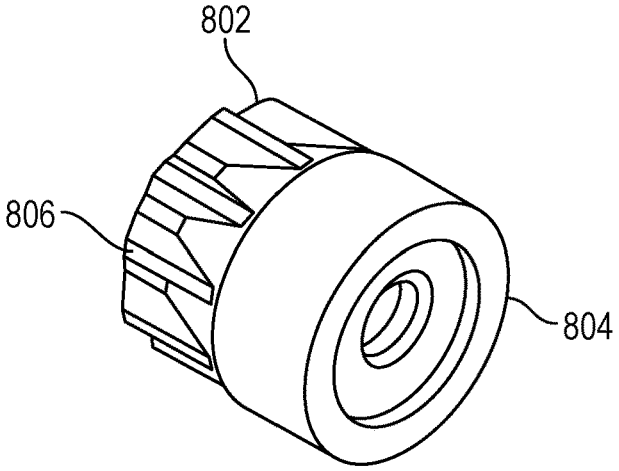

FIGS. 8A-8F illustrate different views of a ratchet gear 208 of the fixing device, according to embodiments of the present invention. FIG. 8A illustrates a front perspective view of the ratchet gear 208. The ratchet gear 208 may include a distal end 802 and a proximal end 804. The ratchet gear 208 may include a plurality of extrusions 806 circumscribing the circumference of the distal end 802 of the ratchet gear 208. The extrusions 806 may be configured to engage with the meshing structure 720 of the ratchet handle 206 (as shown in FIG. 7D and FIG. 7E). Further, the extrusions 806 may be configured to facilitate the restraining of the rotation of the ratchet handle 206, according to an embodiment of the present invention. Furthermore, the ratchet gear 208 may include a threaded longitudinal aperture 808. The threaded longitudinal aperture 808 may be capable for accepting the threaded proximal end 302 of the threaded fastener 202 (not shown). FIG. 8B illustrates the rear perspective view of the ratchet gear 208, in an embodiment of the present invention. The ratchet gear 208 may include a threaded longitudinal aperture 810. The threaded longitudinal aperture may be capable of receiving the threaded proximal end 330 of the threaded rod 328 (not shown).

Figure 8C:
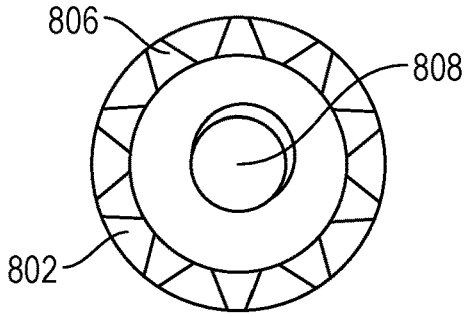
Figure 8D:
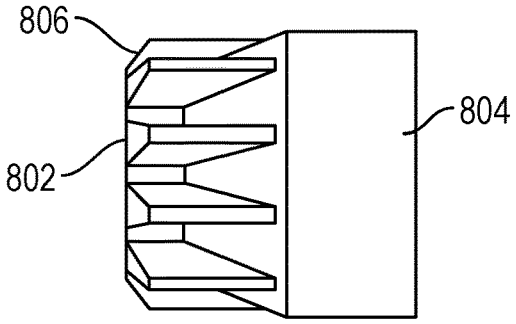

FIG. 8C illustrates a top view of the ratchet gear 208, in an embodiment of the present invention. FIG. 8D illustrates a side view of the ratchet gear 208, in an embodiment of the present invention.

Figure 8E:
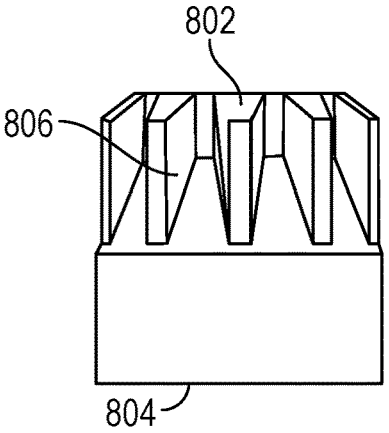
Figure 8F:
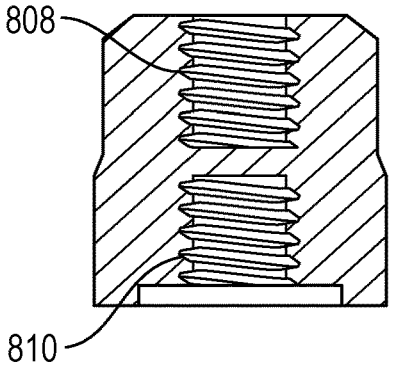

FIG. 8E illustrates a front view of the ratchet gear 208, in an embodiment of the present invention. FIG. 8F illustrates a cross-sectional front view of the ratchet gear 208 showing the threaded longitudinal aperture 808 at the distal end 802 of the ratchet gear 208 which may be capable for accepting the threaded proximal end 302 of the threaded fastener 202 (not shown), as described above. FIG. 8F further illustrates a threaded longitudinal aperture 810 at the proximal end 804 of the ratchet gear 208 that may be capable of receiving the threaded proximal end 330 of the threaded rod 328 (not shown), in an embodiment of the present invention.

FIGS. 9A-9F illustrate different views of the ratchet gear 208 of the fixing device 130, according to alternate embodiments of the present invention. FIG. 9A illustrates a side view of the ratchet gear 208. The ratchet gear 208 may include a distal end 902 and a proximal end 904. The ratchet gear 208 may include a plurality of extrusions 906 circumscribing the circumference of the distal end 902 of the ratchet gear 208. The extrusions 906 may be configured to engage with the meshing structure 720 of the ratchet handle 206 (as shown in the FIG. 7E). Further, the extrusions 906 may be configured to facilitate the restraining of the rotation of the ratchet handle 206, according to an embodiment of the present invention. Furthermore, the ratchet gear 208 may include a threaded rod 908 permanently integrated at the proximal end 904 of the ratchet gear 208. Further, FIG. 9B illustrates a side perspective view of the ratchet gear 208, in an embodiment of the present invention. The distal end 902 of the ratchet gear 208 may include a threaded longitudinal aperture 910. The threaded longitudinal aperture 910 may be capable for accepting the threaded proximal end 402 of the threaded fastener 202 (as shown in the FIG. 4A).

FIG. 9C illustrates a top view of the ratchet gear 208, in an embodiment of the present invention. Further, FIG. 9D illustrates a side perspective view of the ratchet gear 208, in an embodiment of the present invention. FIG. 9E illustrates a front view of the ratchet gear 208, in an embodiment of the present invention.

FIG. 9F illustrates a cross-sectional view of the ratchet gear 208 showing the threaded longitudinal aperture 910, in an embodiment of the present invention.

FIGS. 10A-10D illustrate different views of the pivot pin 212 of the fixing device 130, according to embodiments of the present invention.

Figure 10A:
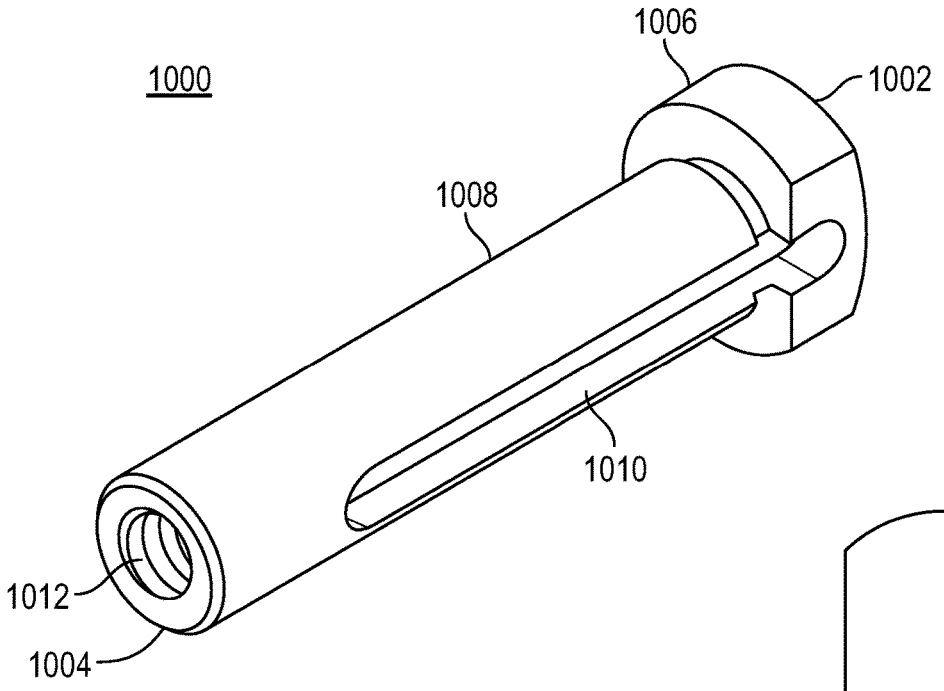
FIGS. 10A-10D illustrate different views of a pivot pin of the fixing device, according to embodiments of the present invention disclosed herein.

FIG. 10A illustrates a side perspective view of the pivot pin 212, in an embodiment of the present invention. The pivot pin 212 comprises a distal end 1002, a proximal end 1004, a head portion 1006, a body 1008 and a slot 1010. The head portion 1006 may be of larger diameter than the body 1008 of the pivot pin 212, in an embodiment of the present invention. The slot 1010 extends through the head portion 1006 and into a length of the body 1008. In an embodiment of the present invention, the slot 1010 of the pivot pin 212 may enable a shooter to allow assembling and/or disassembling the fixing device 130 from the firearm 100. The proximal end 1004 may include a threading cavity 1012 that may engage the threaded rod 428 (as shown in the FIG. 4A).

Figure 10B:
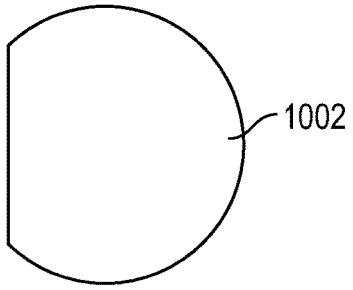
Figure 10C:
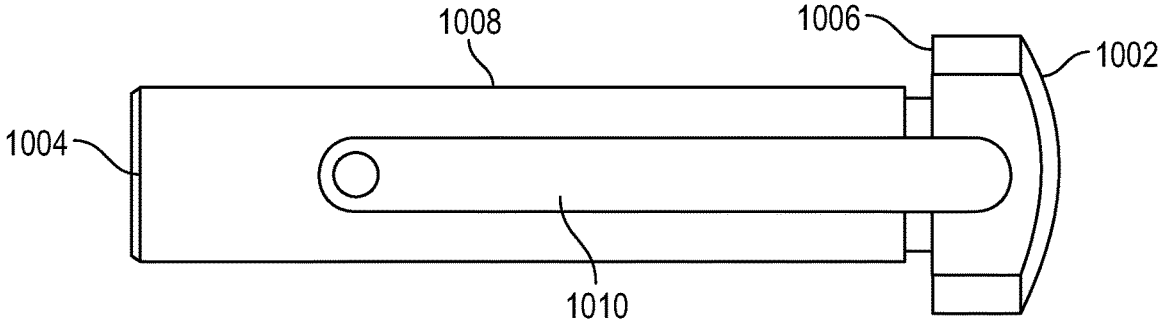
Figure 10D:
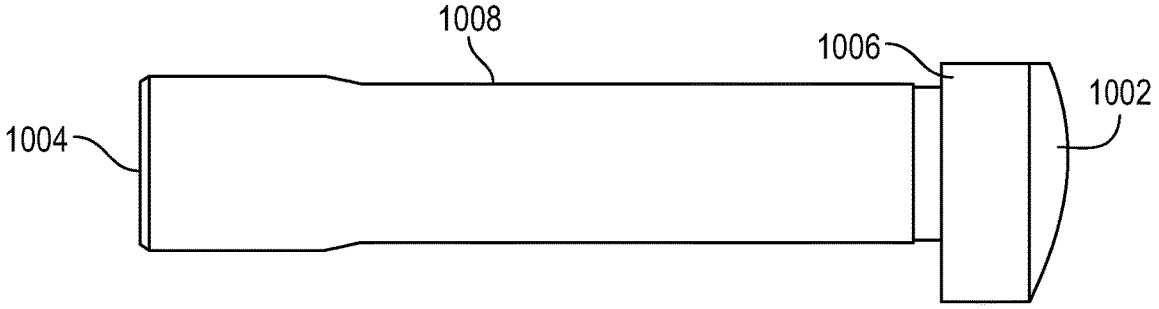

FIG. 10B illustrates a top view of the pivot pin 212, in an embodiment of the present invention. FIG. 10C illustrates a front view of the pivot pin 212, in an embodiment of the present invention. FIG. 10D illustrates a side view of the pivot pin 212, in an embodiment of the present invention.

Figure 11A:
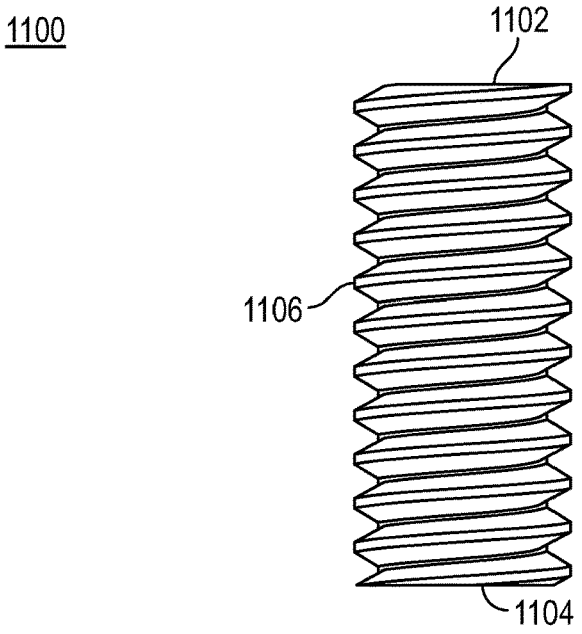
FIGS. 11A-11C illustrate different views of a threaded rod of the fixing device, according to embodiments of the present invention disclosed herein.
Figure 11B:
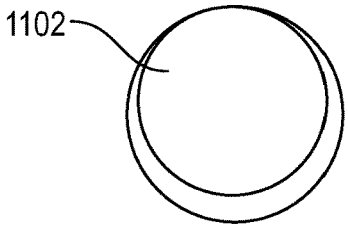
Figure 11C:
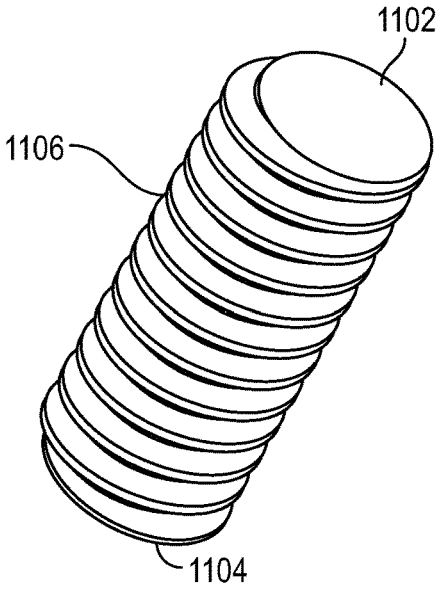

FIGS. 11A-11C illustrate different views of the threaded rod 328 of the fixing device 130, according to alternate embodiments of the present invention. FIG. 11A illustrates a front view of the threaded rod 328. As discussed above, the threaded rod 328 may be for example, but not limited to, a male threaded screw, a set screw, a grub screw, and so forth. Embodiments of the present invention are intended to include or otherwise cover any type of threaded rod, including known, related art, and/or later developed technologies. The threaded rod 328 may be made up of, but not limited to, metal, plastic, or any such material known to a person skilled in the art. Embodiments of the present invention are intended to include or otherwise cover any type of material for manufacturing the threaded rod, including known, related art, and/or later developed technologies that may be beneficial to provide a rigid and sturdy structure to the threaded rod 328. The threaded rod 328 comprises a distal end 1102, a proximal end 1104, and a body 1106. The body 1106 may be threaded along its complete length that may be used to hold the ratchet gear 208 and the pivot pin 212 in a locked position. Further, FIG. 11B illustrates a top view of the threaded rod 328, in an embodiment of the present invention.

FIG. 11C illustrates a side perspective view of the threaded rod 328, in an embodiment of the present invention.

Figure 12A:
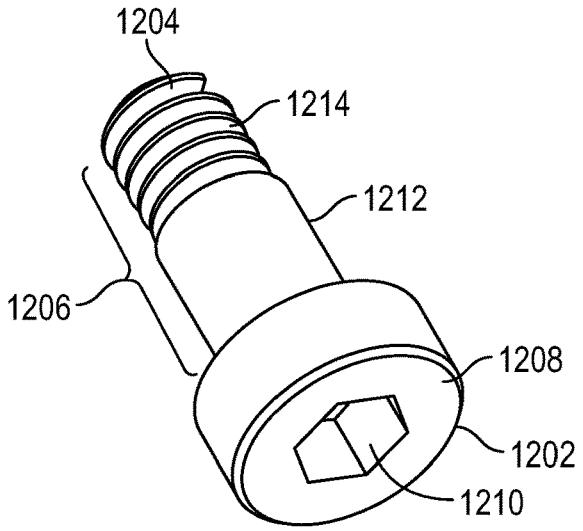
FIGS. 12A-12C illustrate different views of a threaded fastener of the fixing device, according to embodiments of the present invention disclosed herein.
Figure 12B:
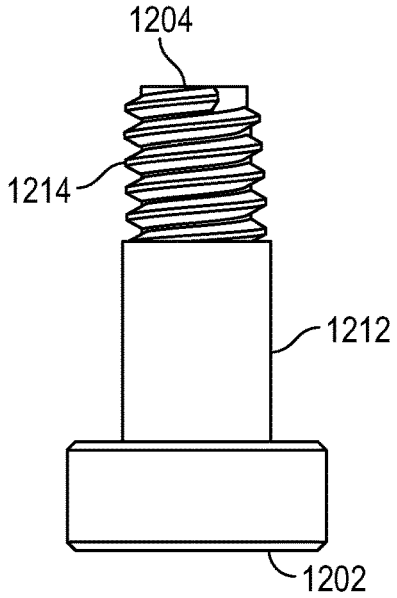
Figure 12C:
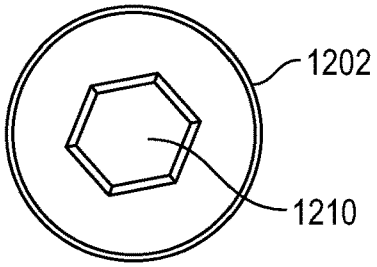

FIGS. 12A-12C illustrate different views of the threaded fastener 202 of the fixing device 130, according to embodiments of the present invention. FIG. 12A illustrates a perspective view of the threaded fastener 202. The threaded fastener 202 comprises a proximal end 1202 and a distal end 1204, and a body 1206. The proximal end 1202 comprises a head 1208 of the threaded fastener 202, which may be used for tightening and/or loosening the fixing device 130 and ultimately the upper receiver assembly 102 and the lower receiver assembly 104 of the firearm 100. In an embodiment of the present invention, the head 1208 may include a slot 1210 for tightening and/or loosening of the threaded fastener 202 with a specialized tool. Further, the body 1206 may include a grip length 1212 and a threaded portion 1214, in an embodiment of the present invention. The grip length 1212 may be capable of providing better shear properties to the threaded fastener 202. Further, the grip length 1212 may allow the ratchet handle 206 (not shown) to be adjusted over the locking plate 210.

FIG. 12B illustrates a front view of the threaded fastener 202, according to an embodiment of the present invention. FIG. 12C illustrates a top view of the threaded fastener 202.

FIGS. 13A-13H illustrate different views of the locking plate 210 of the fixing device 130, according to embodiments of the present invention. FIG. 13A illustrates a front, right side perspective view of the locking plate 210. The locking plate 210 may be made up of, but not limited to, metal, plastic or any such material known to a person skilled in the art. The locking plate 210 comprises a proximal end 1302 and a distal end 1304. In an embodiment of the present invention, the distal end 1304 of the locking plate 210 comprises a plurality of positive stop registration 1306*a*-1306*n* (hereinafter referred to as the positive stop registration 1306). In an embodiment of the present invention, the positive stop registration 1306 may be protruded. The positive stop registration 1306 may be capable of engaging with the lever 412 of the ratchet handle 206 (as shown in the FIG. 4A) to lock the fixed the upper receiver assembly 102 and the lower receiver assembly 104 of the firearm 100. In an embodiment of the present invention, the locking plate 210 may be capable of providing a protection to the firearm 100 against, but not limited to, marring, scratching, and binding being caused during tightening and/or loosening of the upper receiver assembly 102 and the lower receiver assembly 104 of the firearm 100. In an embodiment of the present invention, the locking plate 210 comprises an aperture 1308 and a support plate 1310. The support plate 1310 may be utilized to hold the locking plate 210 against the magazine well 116 (not shown) of the firearm 100. FIG. 13B illustrates a rear, right side perspective view of the locking plate 210, in an embodiment of the present invention.

FIG. 13C illustrates a top view of the locking plate 210, in an embodiment of the present invention. The top view illustrates the protruded positive stop registrations 1306 of the locking plate 210.

FIG. 13D illustrates a side perspective view of the locking plate 210 illustrating the components of the locking plate 210, as discussed above with reference to the FIGS. 13A-13C, in an embodiment of the present invention. FIG. 13E illustrates a front view of the locking plate 210, in an embodiment of the present invention. FIG. 13F illustrates a left side view of the locking plate 210, in an embodiment of the present invention. FIG. 13G illustrates a rear perspective view of the locking plate 210, in an embodiment of the present invention.

FIG. 13H illustrates a rear perspective view of the locking plate 210, in an alternate embodiment of the present invention. The locking plate 210 may be made up of, but not limited to, metal, plastic or any such material known to a person skilled in the art. The locking plate 210 comprises the proximal end 1302 and the distal end 1304. In an embodiment of the present invention, the distal end 1304 of the locking plate 210 comprises a plurality of negative stop registration 1312*a*-1312*n* (hereinafter referred to as the negative stop registration 1312) which may be capable of engaging with the lever 412 of the ratchet handle 206 (not shown). In an embodiment of the present invention, the negative stop registration 1312 may be caved in at the proximal end 1302 of the locking plate 210. In an embodiment of the present invention, the locking plate 210 comprises the aperture 1308 and the support plate 1310. The support plate 1310 may be utilized to hold the locking plate 210 against the magazine well 116 (as shown in the FIG. 1) of the firearm 100.

Figure 14A:
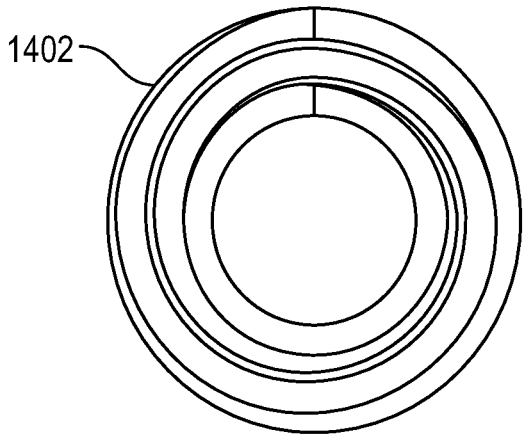
FIGS. 14A-14B illustrate different views of a spring of the fixing device, according to embodiments of the present invention disclosed herein.
Figure 14B:
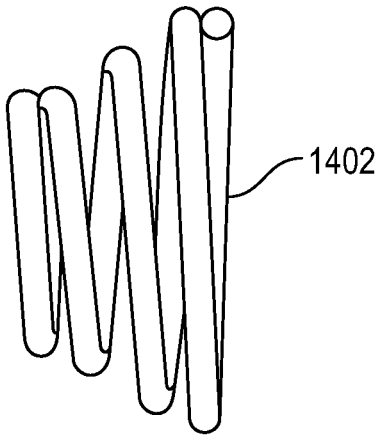

FIGS. 14A-14B illustrate different views of a spring 1402 of the fixing device 130, according to embodiments of the present invention. FIG. 14A illustrates a top view of the spring 1402. The spring 1402 may be for example, but not limited to, a disc spring, at least two opposing flat springs, a spring plate, a coil spring or a conical spring. The spring 1402 may be made up of, but not limited to, metal or any such material known to a person skilled in the art. FIG. 14B illustrates a side view of the spring 1402 in an uncompressed state, in an embodiment of the present invention.

Figure 15:
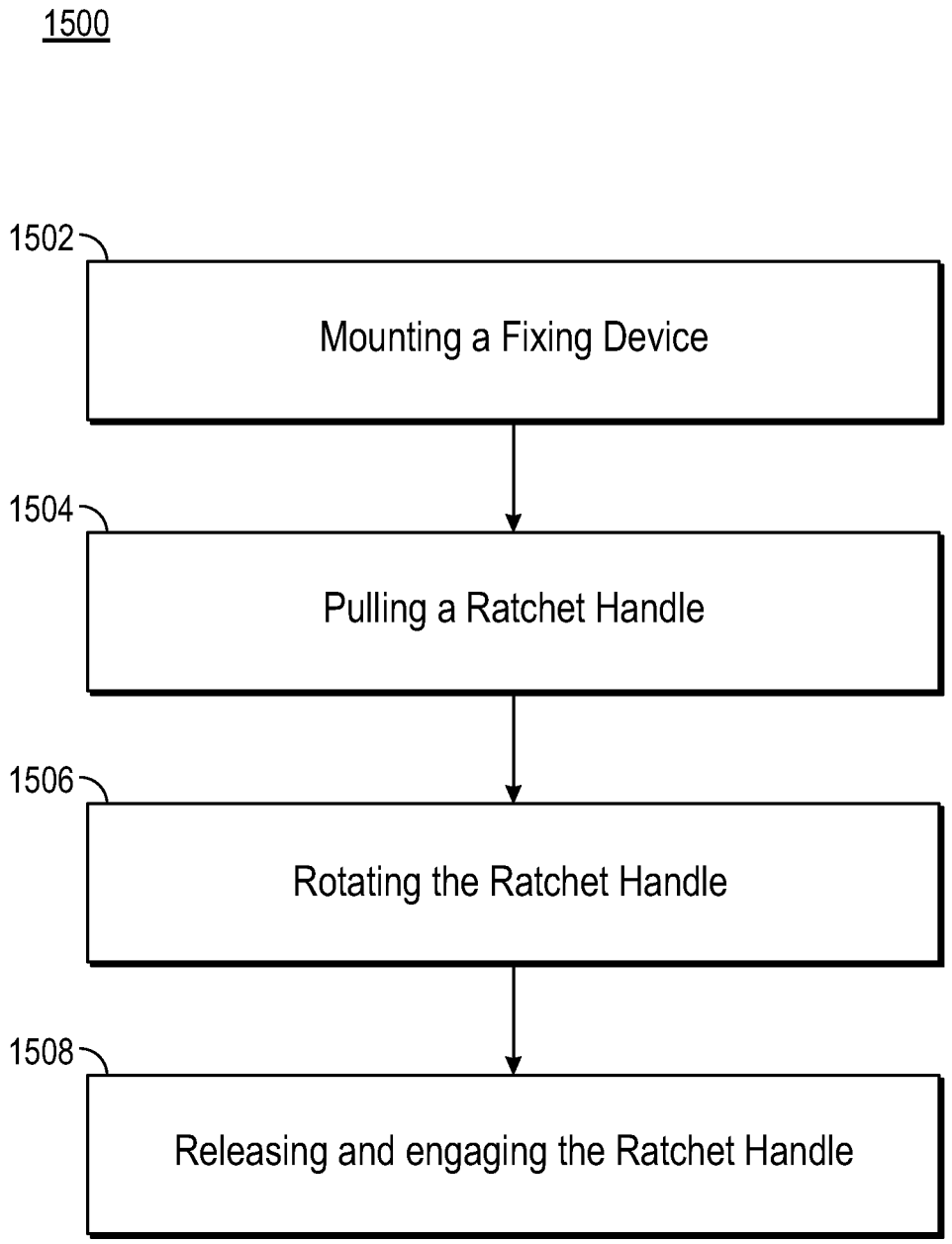
FIG. 15 illustrates a flowchart of a method for mounting and selectively locking the fixing device on the firearm, according to embodiments of the present invention disclosed herein.

FIG. 15 illustrates a flowchart of a method 1500 for mounting and selectively locking the fixing device 130 on the firearm 100, in an embodiment of the present invention.

At step 1502, the fixing device 130 is mounted on the firearm 100. The fixing device 130 may be mounted by fixing together the components of the fixing device 130. The threaded fastener 202 accepts the spring 204 and together they are inserted into the ratchet handle 206 from the distal end 416. In an embodiment of the present invention, the threaded fastener 202 passes through the ratchet handle 206 and threads into the ratchet gear 208. Further, the locking plate 210 is placed on the firearm 100 and is then assembled with the other components including the threaded fastener 202, spring 204, ratchet handle 206, ratchet gear 208, by using the pivot pin 212. In an alternate embodiment of the present invention, the washer 530 may be used instead of the locking plate 210.

At step 1504, the ratchet handle 206 may be released from the extrusions 426 of the ratchet gear 208 while maintaining the connection with the rest of the assembly of the fixing device 130. The ratchet handle 206 may be released by pulling the ratchet handle 206 in a parallel axis to the length of the pivot pin 212, which further compresses the spring 204. This position is known as the disengaged gear position. In this disengaged gear position, the ratchet handle 206 may be able to freely rotate to a desired new position before resetting into the ratchet gear 208. The action of pulling the ratchet handle 206 to achieve the disengaged gear position (as described above) may be repeated as necessary, to achieve a new desired position before resetting into the ratchet gear 208 for further tightening.

At step 1506, the ratchet handle 206 is rotated to tighten and fix the upper receiver assembly 102 and the lower receiver assembly 104 of the firearm 100. The ratchet handle 206 is rotated by turning the ratchet handle 206 with the meshing structure 720 of the ratchet handle 206 engaged to the extrusions 426 of the ratchet gear 208. This position is known as the engaged gear position. In this engaged gear position, the ratchet handle 206 may be turned to a tightened position. The ratchet gear 208 may include a threaded rod 428 on the end opposite to the extrusions 426. When the ratchet handle 206 is turned, the exposed portion of the threaded rod 428 of the ratchet gear 208 is turned into the threaded cavity of the pivot pin 212 until the entire assembly is sufficiently tightened, locking the upper receiver assembly 102 and the lower receiver assembly 104 of the firearm 100.

Next, at step 1508, the ratchet handle 206 is released, which further allows the spring 204 to expand to its uncompressed state. Also, the extrusions 426 of the ratchet gear 208 re-engages with the ratchet handle 206 to allow for further tightening of the upper receiver assembly 102 and the lower receiver assembly 104 of the firearm 100. Further, the locking plate 210 interfaces with the ratchet handle 206 in such a way that the ratchet handle 206 locks into a given position as defined by a user's tightening torque force and the resulting location of the ratchet handle 206 locking tenon 716 in relation to the stop registrations 338 of the locking plate 210 in a locking position. This ensures that the tightened position is maintained so that the lower receiver assembly 104 and the upper receiver assembly 102 may not loosen unintentionally.

Figure 16A:
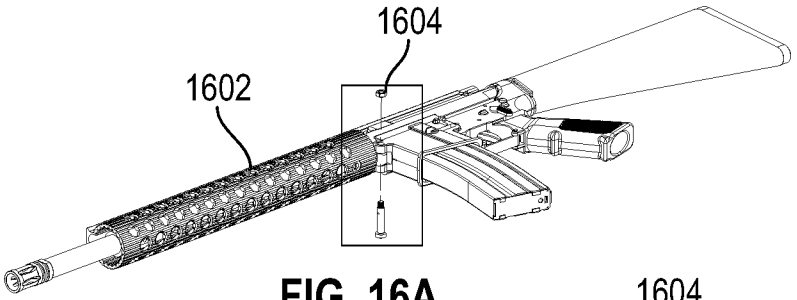
FIGS. 16A-16C illustrate different views of a firearm comprising a fixing device, according to an alternate embodiment of the present invention disclosed herein.
Figure 16C:
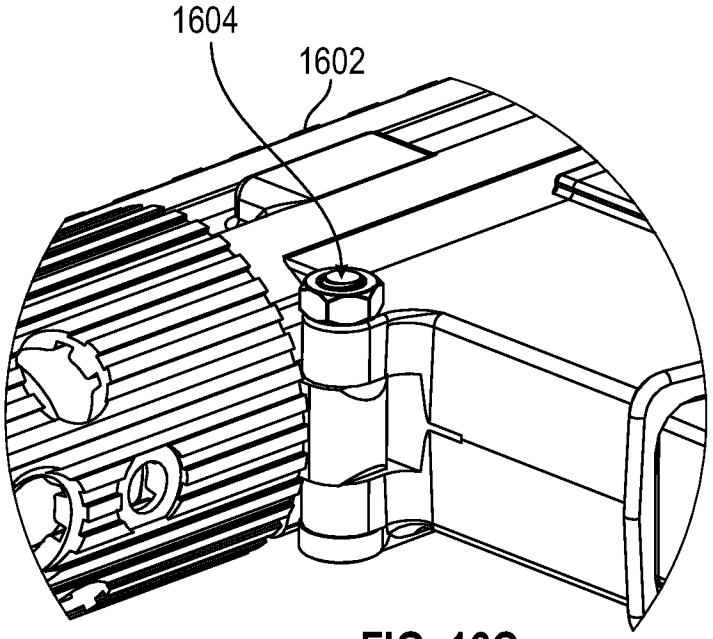
Figure 16B:
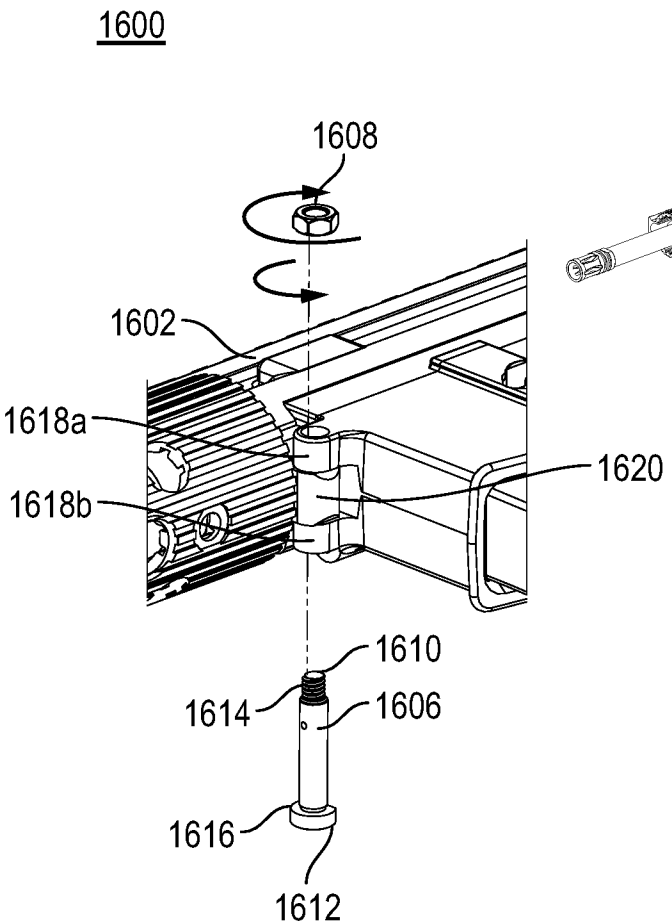

FIGS. 16A-16C illustrate different views of a firearm 1602 comprising a fixing device 1604, according to an alternate embodiment of the present invention. FIG. 16A illustrates a perspective view of a system 1600 depicting a firearm 1602 and a fixing device 1604, according to an alternate embodiment of the present invention. The firearm 1602 comprises similar components of the firearm 100 described in FIG. 1 above.

FIG. 16B illustrates an enhanced perspective view of the system 1600 depicting the firearm 1602 and an exploded view of the fixing device 1604, according to an alternate embodiment of the present invention. The fixing device 1604 comprises a threaded fastener 1606 and a nut 1608. The threaded fastener 1606 may include a proximal end 1610 and a distal end 1612. The proximal end 1610 of the threaded fastener 1606 may comprise a threaded portion 1614 that may be capable of receiving the nut 1608. The distal end 1612 of the threaded fastener 1606 may include a head 1616 that may be rotated for tightening and/or loosening the threaded fastener 1606. In an embodiment of the present invention, the head 1616 of the threaded fastener 1606 may be, but not limited to, a flat head, a pan head, an oval head, a round head, a hexagonal head and so forth. Further, the threaded fastener 1606 may be inserted through lugs 1618*a*-1618*b* (hereinafter referred to as lugs 1618) of the lower receiver 114 and a socket 1620 of the upper receiver 106 of the firearm 1602. Furthermore, the nut 1608 may be threaded onto the threaded portion 1614 of the threaded fastener 1606. The nut 1608 may be rotated in a clockwise direction for assembling the fixing device 1604 on the firearm 1602, in an embodiment of the present invention. In another embodiment of the present invention, the nut 1608 may be rotated in a counter-clockwise direction for disassembling the fixing device 1604 from the firearm 1602.

FIG. 16C illustrates an enhanced perspective view of the system 1600 depicting the fixing device 1604 in an assembled position on the firearm 1602, according to an alternate embodiment of the present invention.

Figure 17A:
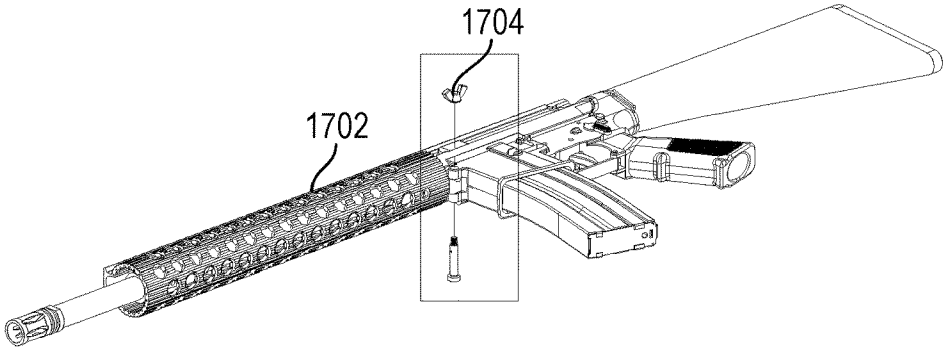
FIGS. 17A-17C illustrate different views of a firearm comprising a fixing device, according to an alternate embodiment of the present invention disclosed herein.
Figure 17C:
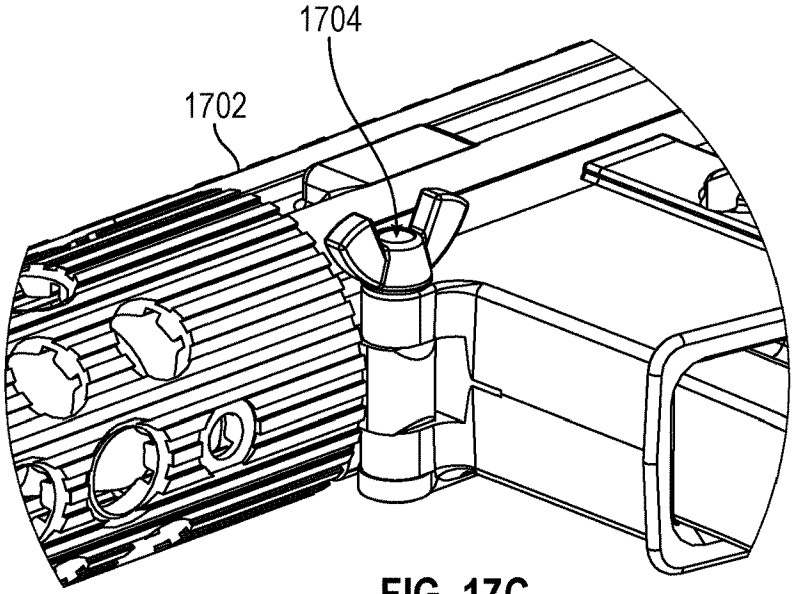
Figure 17B:
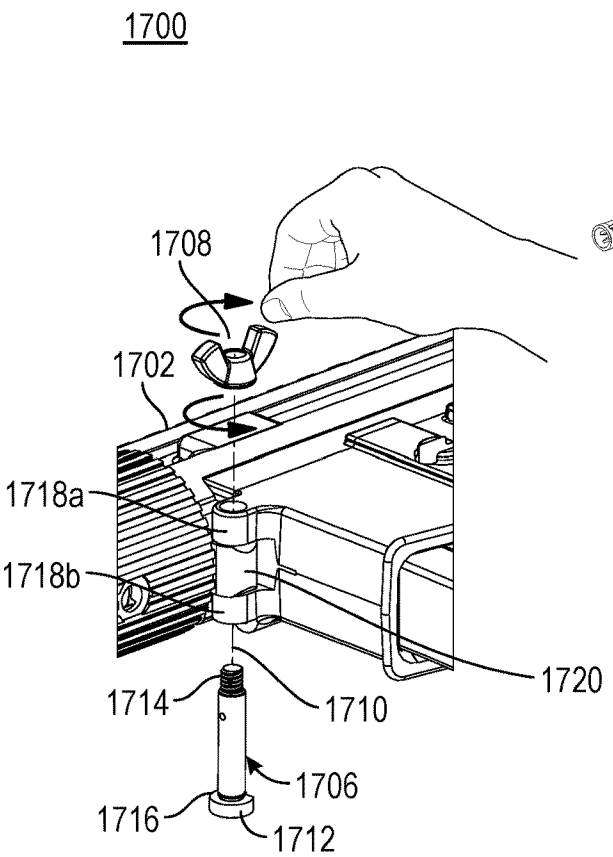

FIGS. 17A-17C illustrate different views of a firearm 1702 comprising a fixing device 1704, according to an alternate embodiment of the present invention. FIG. 17A illustrates a perspective view of a system 1700 depicting a firearm 1702 and a fixing device 1704, according to an alternate embodiment of the present invention. The firearm 1702 comprises similar components as the firearm 100 described above in the FIG. 1.

FIG. 17B illustrates an enhanced perspective view of the system 1700 depicting the firearm 1702 and an exploded view of the fixing device 1704, according to an alternate embodiment of the present invention. The fixing device 1704 comprises a threaded fastener 1706 and a hand nut 1708. The threaded fastener 1706 may include a proximal end 1710 and a distal end 1712. The proximal end 1710 of the threaded fastener 1706 may comprise a threaded portion 1714 that may be capable of receiving the hand nut 1708.

The distal end 1712 of the threaded fastener 1706 may include a head 1716 that may be rotated for tightening and/or loosening the threaded fastener 1706. In an embodiment of the present invention, the head 1716 of the threaded fastener 1706 may be, but not limited to, a flat head, a pan head, an oval head, a round head, a hexagonal head and so forth. Further, the threaded fastener 1706 may be inserted through lugs 1718*a*-1718*b* (hereinafter referred to as lugs 1718) of the lower receiver 114 and a socket 1720 of the upper receiver 106 of the firearm 1702. Furthermore, the hand nut 1708 may be threaded onto the threaded portion 1714 of the threaded fastener 1706. In an embodiment of the present invention, the hand nut 1708 may be rotated in a clockwise direction for assembling the fixing device 1704 on the firearm 1702. The hand nut 1708 may be rotated in a counter-clockwise direction for disassembling the fixing device 1704 from the firearm 1702, in another embodiment of the present invention. In an embodiment of the present invention, the hand nut 1708 may be for example, but is not limited to, a wing nut, a thumb nut, a threaded knob, and so forth. Embodiments of the present invention are intended to include or otherwise cover any type and/or shape of the hand nut 1708, including known, related art, and/or later developed technologies.

FIG. 17C illustrates an enhanced perspective view of the system 1700 depicting the fixing device 1704 in an assembled position on the firearm 1702, according to an alternate embodiment of the present invention.

Figure 18C:
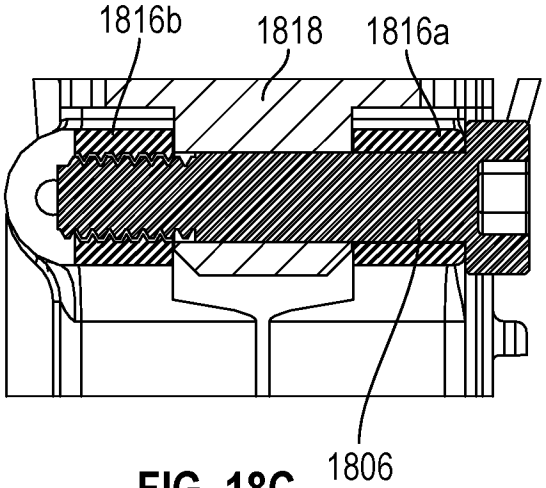
FIGS. 18A-18D illustrate different views of a firearm comprising a fixing device, according to an alternate embodiment of the present invention disclosed herein.
Figure 18D:
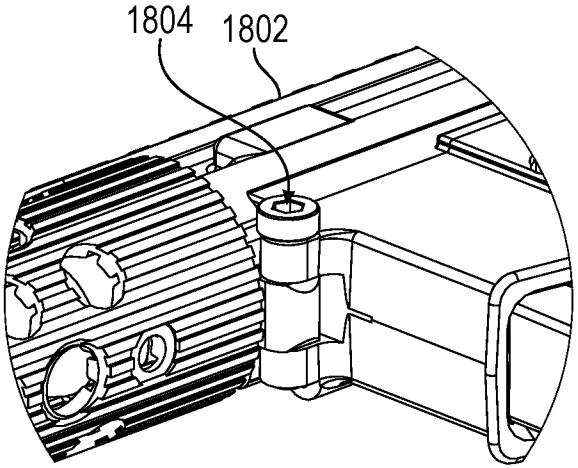
Figure 18A:
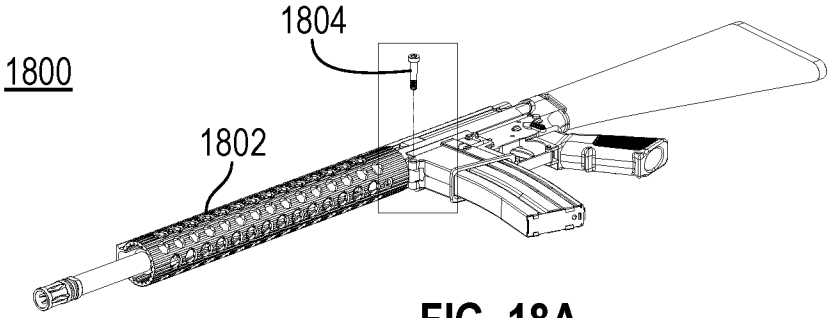

FIGS. 18A-18D illustrate different views of a firearm 1802 comprising a fixing device 1804, according to an alternate embodiment of the present invention. FIG. 18A illustrates a perspective view of a system 1800 depicting the firearm 1802 and the fixing device 1804, according to an alternate embodiment of the present invention. The firearm 1802 comprises similar components as the firearm 100 described above in the FIG. 1.

Figure 18B:
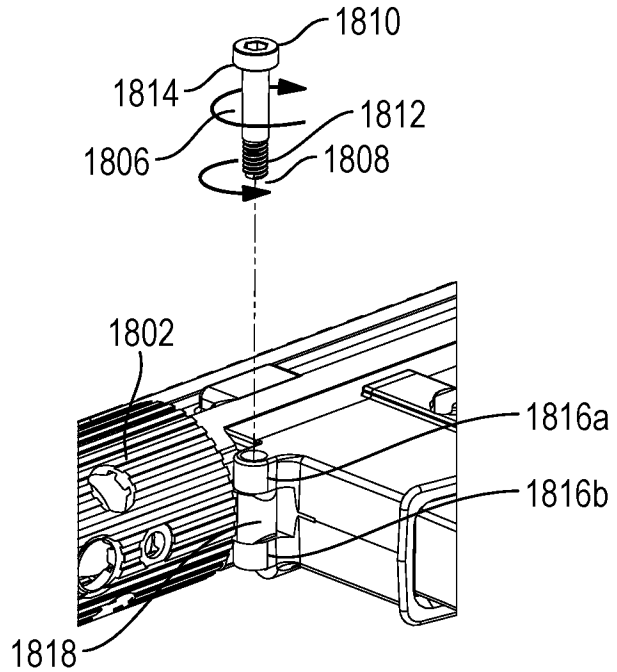

FIG. 18B illustrates an enhanced perspective view of the system 1800 depicting the firearm 1802 and an exploded view of the fixing device 1804, according to an alternate embodiment of the present invention. The fixing device 1804 comprises a threaded fastener 1806. The threaded fastener 1806 may include a proximal end 1808 and a distal end 1810. The proximal end 1808 of the threaded fastener 1806 may comprise a threaded portion 1812. The distal end 1810 of the threaded fastener 1806 may include a head 1814 that may be rotated for tightening and/or loosening the upper receiver assembly 102 and the lower receiver assembly 104 of the firearm 1802. In an embodiment of the present invention, the head 1816 of the threaded fastener 1806 may be, but not limited to, a flat head, a pan head, an oval head, a round head, a hexagonal head and so forth. Further, the threaded fastener 1806 may be inserted through lugs 1816*a* and 1816*b* of the lower receiver and the socket 1818 of the upper receiver of the firearm 1802. In an embodiment of the present invention, a receiver lug, opposite to the lug from where the threaded fastener 1806 is inserted, accepts and threads the threaded fastener 1806. The proximal threaded end 1808 may be turned in a clockwise direction to tighten the upper receiver assembly 102 and the lower receiver assembly 104 of the firearm 1802, in an embodiment of the present invention. In another embodiment of the present invention, the proximal threaded end 1808 may be turned in an anti-clockwise direction to loosen the upper receiver assembly 102 and the lower receiver assembly 104 of the firearm 1802, which mitigates the play such as wiggle, waggle, rattle, bob, and so forth.

FIG. 18C illustrates a cross-sectional view of the system 1800 when the fixing device 1804 is assembled on the firearm 1802, according to an alternate embodiment of the present invention. The threaded fastener 1806 may be inserted through the lugs 1816*a*-1816*b* (hereinafter referred to as lugs 1818) of the lower receiver 114 and the socket 1818 of the upper receiver 106 of the firearm 1802.

FIG. 18D illustrates an enhanced perspective view of the system 1800 depicting the system 1800 when the fixing device 1804 is assembled on the fixing device 1802, according to an alternate embodiment of the present invention.

Figure 19A:
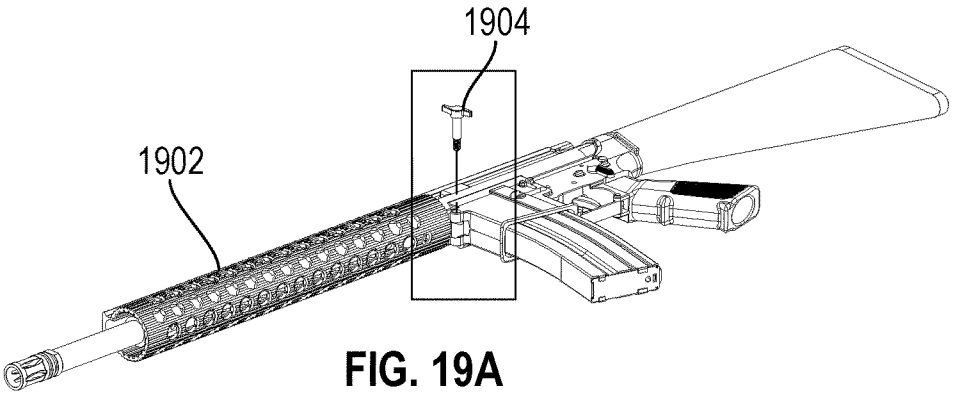
FIGS. 19A-19C illustrate different views of a firearm comprising a fixing device, according to an alternate embodiment of the present invention disclosed herein.
Figure 19C:
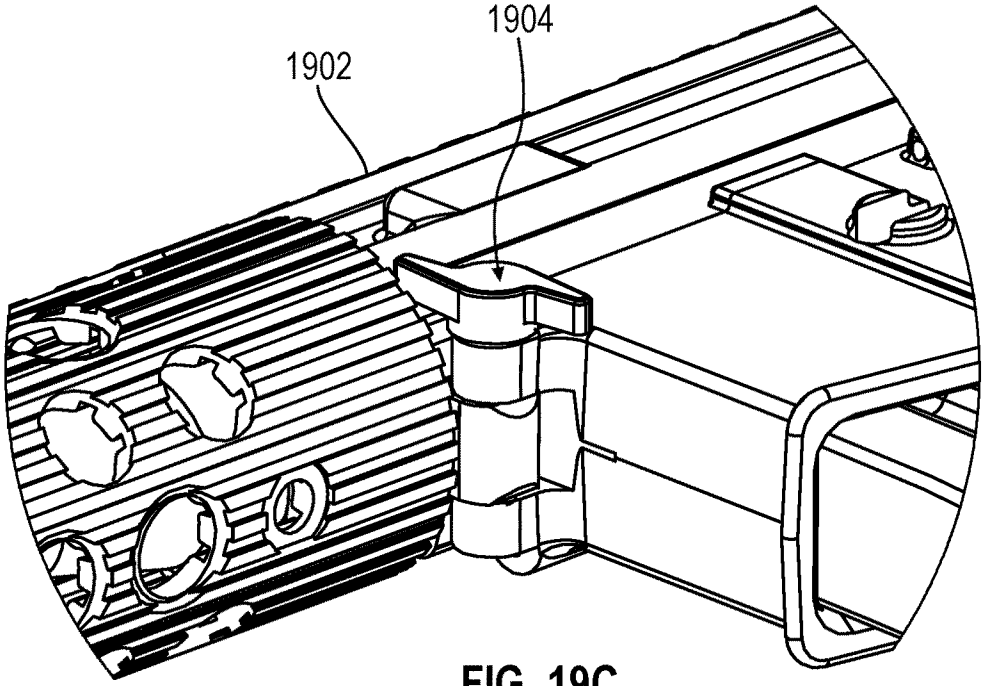
Figure 19B:
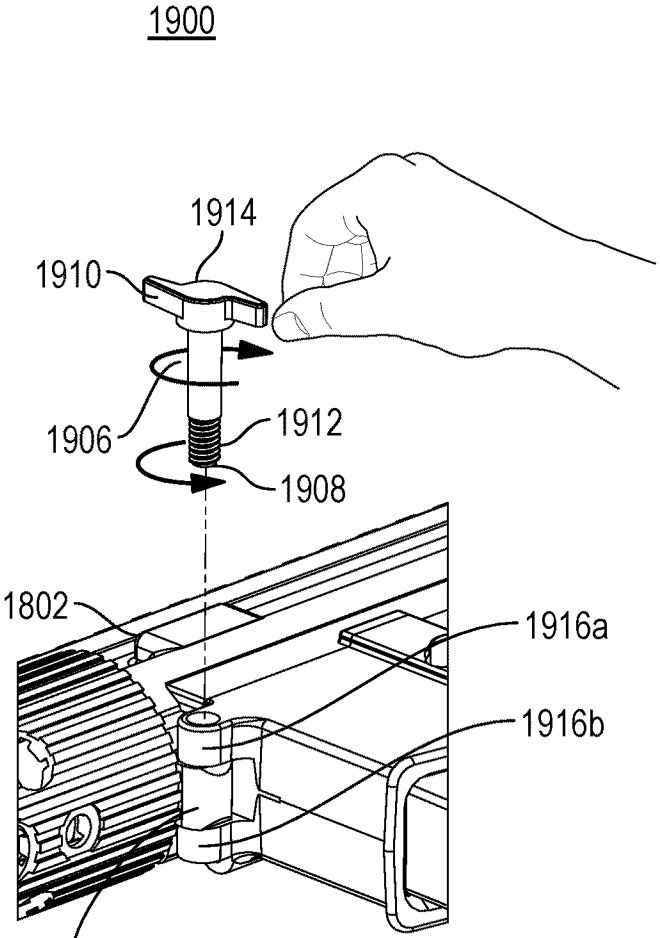

FIGS. 19A-19C illustrate different views of a firearm 1902 comprising a fixing device 1904, according to an alternate embodiment of the present invention. FIG. 19A illustrates the perspective view of a system 1900 depicting the firearm 1902 and the fixing device 1904, according to an alternate embodiment of the present invention. The firearm 1902 comprises similar components as a firearm 100 described above in FIG. 1.

FIG. 19B illustrates an enhanced perspective view of the system 1900 depicting the firearm 1902 and an exploded view of the fixing device 1904, according to an alternate embodiment of the present invention. The fixing device 1904 comprises a hand screw 1906. The hand screw 1906 may include a proximal end 1908 and a distal end 1910. The proximal end 1908 of the hand screw 1906 may comprise a threaded portion 1912. The distal end 1910 of the hand screw 1906 may include a head 1914 that may be rotated for tightening and/or loosening the hand bolt 1906. The hand screw 1906 may be inserted through lugs 1916*a*-1916*b* (hereinafter referred to as lugs 1916) of the lower receiver and a socket 1918 of the upper receiver of the firearm 1902. In an embodiment of the present invention, the hand screw 1906 may be for example, but is not limited to, a wing screw, a thumb screw, a t-screw, a multi-lobe screw, and so forth. Embodiments of the present invention are intended to include or otherwise cover any type and/or shape of the hand screw 1906, including known, related art, and/or later developed technologies. The lugs 1916 opposite to the insertion point of the hand screw 1906 may comprise a threaded aperture (not shown) that may be capable of accepting the threaded portion 1912 of the hand screw 1906. In an embodiment of the present invention, the head 1914 of the hand screw 1906 may be rotated in a clockwise and/or counter-clockwise direction for tightening and/or loosening the upper receiver assembly 102 and the lower receiver assembly 104 of the firearm 1902.

FIG. 19C illustrates an enhanced perspective view of the system 1900 depicting an assembled view of the fixing device 1904 on the firearm 1902, according to an alternate embodiment of the present invention.

Figure 20A:
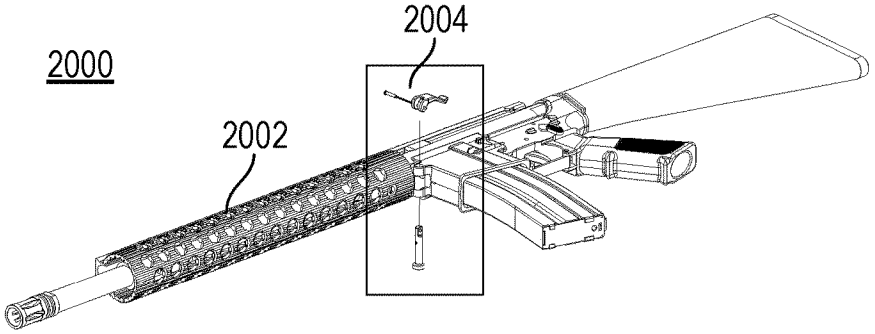
FIGS. 20A-20D illustrate different views of a firearm comprising a fixing device, according to an alternate embodiment of the present invention disclosed herein.

FIGS. 20A-20D illustrate different views of a firearm 2002 comprising a fixing device 2004, according to an alternate embodiment of the present invention. FIG. 20A illustrates the perspective view of a system 2000 depicting the firearm 2002 and the fixing device 2004, according to an alternate embodiment of the present invention. The firearm 2002 comprises similar components as the firearm 100 described above in the FIG. 1.

Figure 20B:
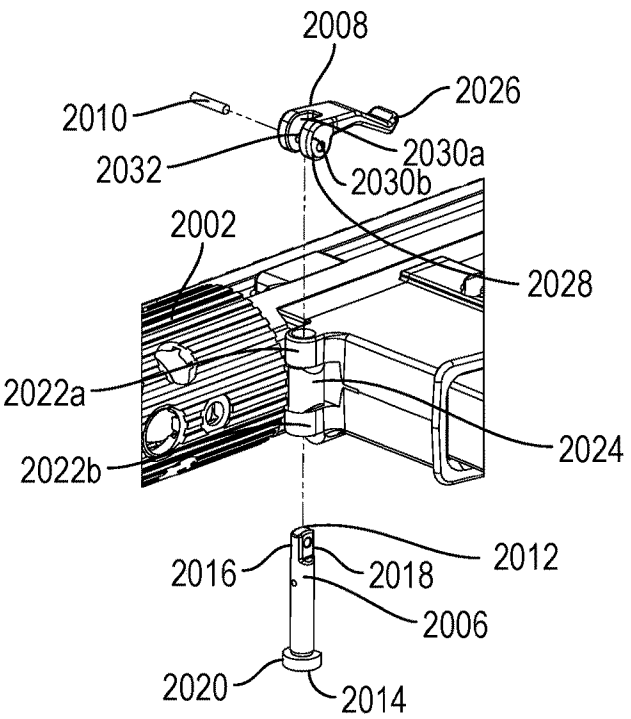

FIG. 20B illustrates an enhanced perspective view of the system 2000 depicting the firearm 2002 and an exploded view of the fixing device 2004, according to an alternate embodiment of the present invention. The fixing device 2004 comprises a post fastener 2006, a cam handle 2008 and a pin 2010. The post fastener 2006 may include a proximal end 2012 and a distal end 2014. The proximal end 2012 of the post fastener 2016 may comprise a slot with a hole 2018 that may be capable of receiving the pin 2010. The distal end 2014 of the post fastener 2006 may include a head 2020. In an embodiment of the present invention, the head 2020 of the post fastener 2006 may be, but not limited to, a flat head, a pan head, an oval head, a round head, a hexagonal head and so forth. Further, the post fastener 2006 may be inserted through lugs 2022*a*-2022*b* (hereinafter referred to as lugs 2022) of the lower receiver 114 and a socket 2024 of the upper receiver 106 of the firearm 2002. The cam handle 2008 may comprises a lever 2026 and a cylindrical portion 2028. Further, the cylindrical portion 2028 comprises two parallel legs 2030*a*-2030*b* (hereinafter referred to as legs 2030) and an aperture 2032. In an embodiment of the present invention, the legs 2030 may be capable of accepting the slot of the post fastener 2006. Further, the pin 2010 may be inserted through the intersecting aperture 2032 and the hole 2018 for locking the post fastener 2006 with the cam handle 2008.

Figure 20C:
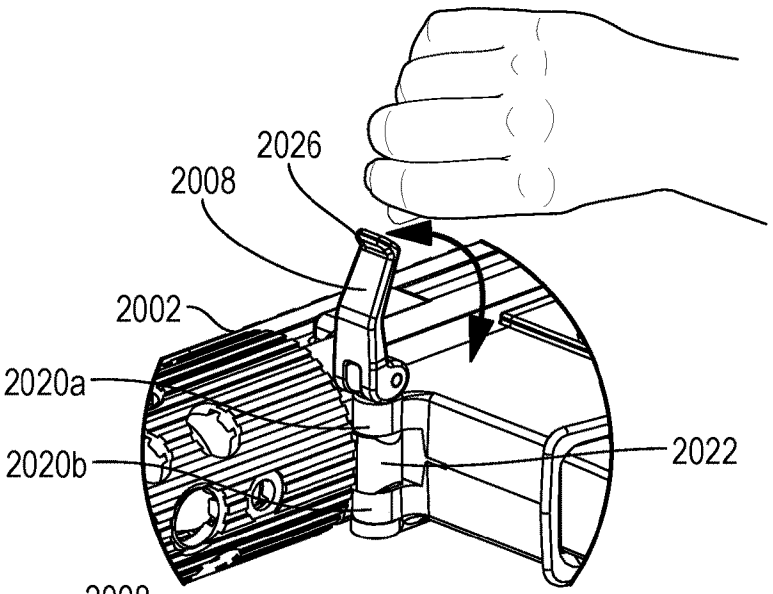

FIG. 20C illustrates an enhanced perspective view of the system 2000 depicting the fixing device 2004 assembled on the firearm 2002 in its working position depicting the tightening or loosening action of the cam handle 2008 to lock the upper receiver assembly 102 and the lower receiver assembly 104 of the firearm 2002, according to an alternate embodiment of the present invention. The lever 2026 of the cam handle 2008 may be pulled upwards away from the magazine well (not shown) of the firearm 2002, thus loosening the lugs 2022 and the socket 2024 of the firearm 2002, in an embodiment of the present invention.

Figure 20D:
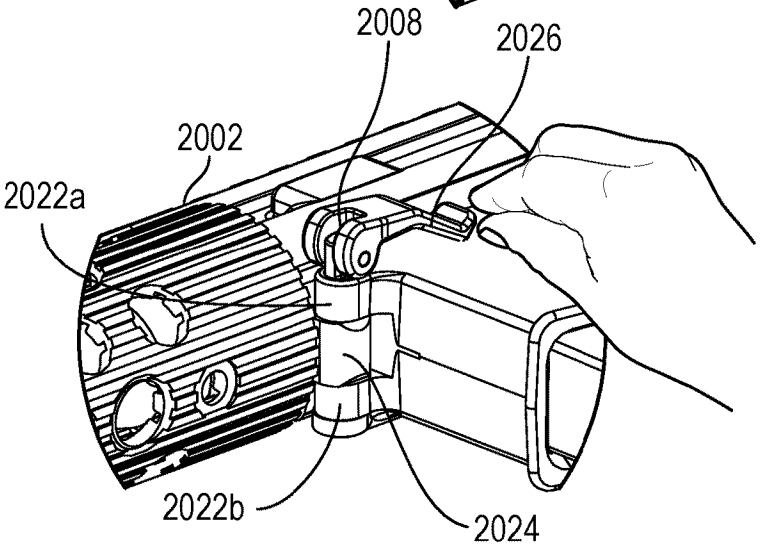

FIG. 20D illustrates an enhanced perspective view of the system 2000 depicting assembled view of the fixing device 2004 onto the firearm 2002, according to an alternate embodiment of the present invention. The lever 2026 of the cam handle 2008 may be lowered towards the magazine well (not shown) and locked, thus tightening the lugs 2022 with the socket 2024 of the firearm 2002, in an embodiment of the present invention.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to firearms. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of assembling a lower receiver and an upper receiver of a firearm, the method comprising the steps of:

on one side of the lower receiver, providing a threaded fastener having a proximal end and a distal end;

inserting the threaded fastener into a ratchet handle along a longitudinal axis at the proximal end of the threaded fastener;

mounting a ratchet gear into the ratchet handle at the opposite side of the threaded fastener, wherein the threaded fastener passes through an aperture of the ratchet handle and threads into the ratchet gear;

positioning a locking plate at the lower receiver, wherein the ratchet handle is attached to the locking plate through the ratchet gear for locking the ratchet handle in a locked position; and on opposite side of the lower receiver, inserting a pivot pin through an aperture of the locking plate from the opposite side of the lower receiver, wherein a threaded rod of the ratchet gear is threaded into a threaded cavity of the pivot pin.

2. The method of claim 1, further providing a spring disposed at the proximal end of the threaded fastener between the threaded fastener and the ratchet handle.

3. The method of claim 1, wherein the ratchet handle comprises a cylindrical portion having a proximal end and a distal end, wherein the ratchet handle is capable of accepting the threaded fastener at the distal end and the ratchet gear at the proximal end.

4. The method of claim 1, wherein the ratchet gear is rotatably mounted into the ratchet handle.

5. The method of claim 1, wherein the rachet gear further comprises a plurality of extrusions circumscribing a circumference of the ratchet gear at a distal end and a threaded rod at the proximal end.

6. The method of claim 5, wherein the plurality of extrusions are capable of meshing with the ratchet handle.

7. The method of claim 5, wherein the plurality of extrusions are capable of facilitating the restraining of rotation of the ratchet handle.

8. The method of claim 1, further comprising accepting the threaded rod at least in part in a threaded, longitudinal aperture of the ratchet gear.

9. The method of claim 1, wherein the threaded rod of the ratchet gear having a proximal end and a distal end, wherein the proximal end of the threaded rod is inserted in the pivot pin and the distal end of the threaded rod is inserted in the ratchet gear.

10. The method of claim 1, wherein the threaded rod is integrated into the ratchet gear.

11. A fixing device for assembling a lower receiver and an upper receiver of a firearm comprising:

a threaded fastener having a proximal end and a distal end;

a ratchet handle comprising a cylindrical portion having a proximal end, a distal end, and a lever, wherein the rachet handle is capable of facilitating tightening and/or loosening of the lower receiver and the upper receiver by rotating the lever;

a ratchet gear comprising a plurality of extrusions, wherein the plurality of extrusions are capable of facilitating a restraining of rotation of the ratchet handle;

a locking plate comprising a plurality of stop registrations, wherein the plurality of stop registrations are capable of locking the ratchet handle in a locked position by locking the lever of the ratchet handle into one of the plurality of stop registrations; and a pivot pin capable of inserting through lugs of the upper receiver, the lower receiver, and an aperture of the locking plate from an opposite side of the lower receiver, wherein a threaded rod of the ratchet gear is threaded into a threading cavity of the pivot pin for tightening and fixing the upper receiver and the lower receiver of the firearm.

12. The device of claim 11, further comprising a spring disposed at the proximal end of the threaded fastener between the threaded fastener and the ratchet handle.

13. The device of claim 11, wherein the ratchet handle comprises a cylindrical portion having a proximal end and a distal end for accepting the threaded fastener at the distal end and the ratchet gear at the proximal end.

14. The device of claim 11, wherein the rachet gear further comprises a plurality of extrusions circumscribing a circumference of the ratchet gear at a distal end and the threaded rod at a proximal end.

15. The device of claim 14, wherein the plurality of extrusions are capable of facilitating the restraining of rotation of the ratchet handle.

16. The device of claim 11, wherein the ratchet gear accepts the threaded rod at least in part in a longitudinal aperture.

17. The device of claim 11, wherein the threaded rod comprises a proximal end and a distal end, wherein the proximal end of the threaded rod is inserted in the longitudinal aperture of the pivot pin and the distal end of the threaded rod is inserted in the ratchet gear.

18. The device of claim 11, wherein the threaded rod is integrated into the ratchet gear.

19. A firearm fixing system, the system comprising:

a lower receiver assembly;

an upper receiver assembly; and a fixing device for fixing the lower receiver assembly and the upper receiver assembly, wherein the fixing device comprising:

a threaded fastener having a proximal end and a distal end;

a ratchet handle comprising a cylindrical portion having a proximal end, a distal end, and a lever, wherein the rachet handle is capable of facilitating tightening and/or loosening of the lower receiver assembly and the upper receiver assembly by rotating the lever;

a ratchet gear comprising a plurality of extrusions, wherein the plurality of extrusions are capable of facilitating a restraining of rotation of the ratchet handle;

a locking plate comprising a plurality of stop registrations, wherein the plurality of stop registrations are capable of locking the ratchet handle in a locked position by locking the lever of the ratchet handle into one of the plurality of stop registrations; and a pivot pin capable of inserting through lugs of the upper receiver, the lower receiver, and an aperture of the locking plate from an opposite side of the lower receiver assembly, wherein a threaded rod of the ratchet gear is threaded into a threaded cavity of the pivot pin for tightening and fixing the upper receiver and the lower receiver of the firearm.

20. The system of claim 19, further comprising a spring disposed at the proximal end of the threaded fastener between the threaded fastener and the ratchet handle.

21. The system of claim 19, wherein the rachet gear further comprises a plurality of extrusions circumscribing a circumference of the ratchet gear at a distal end and the threaded rod at a proximal end.

22. The system of claim 19, wherein the threaded rod comprises a proximal end and a distal end, wherein the proximal end of the threaded rod is inserted in the longitudinal aperture of the pivot pin and the distal end of the threaded rod is inserted in the ratchet gear.

23. The system of claim 19, wherein the threaded rod is integrated into the ratchet gear.

* * * * *